US009939744B2

(12) United States Patent
Azuma et al.

(10) Patent No.: US 9,939,744 B2
(45) Date of Patent: Apr. 10, 2018

(54) MULTI-LAYER ELECTROPHOTOGRAPHIC PHOTOSENSITIVE MEMBER

(71) Applicant: KYOCERA Document Solutions Inc., Osaka (JP)

(72) Inventors: Jun Azuma, Osaka (JP); Kensuke Okawa, Osaka (JP); Junichiro Otsubo, Osaka (JP); Akihiko Ogata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/254,012

(22) Filed: Sep. 1, 2016

(65) Prior Publication Data

US 2017/0068178 A1 Mar. 9, 2017

(30) Foreign Application Priority Data

Sep. 4, 2015 (JP) ..... 2015-174537

(51) Int. Cl.
*G03G 5/06* (2006.01)
*G03G 5/05* (2006.01)
*G03G 5/047* (2006.01)

(52) U.S. Cl.
CPC ..... *G03G 5/0546* (2013.01); *G03G 5/047* (2013.01); *G03G 5/0507* (2013.01); *G03G 5/0614* (2013.01); *G03G 5/0672* (2013.01)

(58) Field of Classification Search
CPC ... G03G 5/0507; G03G 5/0564; G03G 5/0614
See application file for complete search history.

(56) References Cited

U.S. PATENT DOCUMENTS

2011/0206411 A1* 8/2011 Mizushima ..... G03G 5/04 399/111
2012/0052425 A1* 3/2012 Jun ..... G03G 5/0564 430/56

(Continued)

FOREIGN PATENT DOCUMENTS

JP 2001-066800 A 3/2001
JP 2005-196106 * 7/2005 ..... G03G 5/147

OTHER PUBLICATIONS

Translation of JP 2005-196106 published Jul. 2005.*

*Primary Examiner* — Peter L Vajda
(74) *Attorney, Agent, or Firm* — Studebaker & Brackett PC

(57) ABSTRACT

A multi-layer electrophotographic photosensitive member includes a conductive substrate and a photosensitive layer. The photosensitive layer includes a charge generating layer and a charge transport layer. The charge generating layer contains a charge generating material. The charge transport layer contains a charge transport material, a binder resin, and silica particles. The charge transport layer is a monolayer. The charge transport layer is disposed as an outermost surface layer of the multi-layer electrophotographic photosensitive member. The silica particles have a content of at least 0.5 parts by mass and no greater than 15 parts by mass relative to 100 parts by mass of the binder resin. The binder resin includes a polyarylate resin. The polyarylate resin has a repeating unit represented by general formula (I) shown below. In general formula (I), $R_1$-$R_3$ and Y are defined as those described in the specification.

(Continued)

(I)

5 Claims, 1 Drawing Sheet

(56) References Cited

U.S. PATENT DOCUMENTS

2013/0122408 A1* 5/2013 Haruyama ..... G03G 15/75
430/56
2014/0295334 A1* 10/2014 Hirakata ..... G03G 5/0436
430/56

* cited by examiner

MULTI-LAYER ELECTROPHOTOGRAPHIC PHOTOSENSITIVE MEMBER

INCORPORATION BY REFERENCE

The present application claims priority under 35 U.S.C. § 119 to Japanese Patent Application No. 2015-174537, filed on Sep. 4, 2015. The contents of this application are incorporated herein by reference in their entirety.

BACKGROUND

The present disclosure relates to a multi-layer electrophotographic photosensitive member.

An electrophotographic photosensitive member is used as an image bearing member in an electrographic image forming apparatus (for example, a printer or a multifunction peripheral). The electrophotographic photosensitive member includes a photosensitive layer. An example of electrophotographic photosensitive members is a multi-layer electrophotographic photosensitive member. The multi-layer electrophotographic photosensitive member includes a photosensitive layer that includes a charge generating layer having a charge generating function and an charge transport layer having a charge transport function.

The following electrophotographic photosensitive member has been known. The electrophotographic photosensitive member has a surface layer that contains a modified polycarbonate resin and silica particles. The modified polycarbonate resin has a repeating unit in a siloxane structure. The silica particles have a mean volume diameter of at least 0.005 μm and no greater than 0.05 μm.

SUMMARY

A electrophotographic photosensitive member according to the present disclosure includes a conductive substrate and a photosensitive layer. The photosensitive layer includes a charge generating layer containing a charge generating material and a charge transport layer containing a charge transport material, a binder resin, and silica particles. The charge transport layer is a monolayer. The charge transport layer is disposed as an outermost surface layer of the multi-layer electrophotographic photosensitive member. The silica particles have a content of at least 0.5 parts by mass and no greater than 15 parts by mass relative to 100 parts by mass of the binder resin. The binder resin contains a polyarylate resin. The polyarylate resin has a repeating unit represented by general formula (I) shown below:

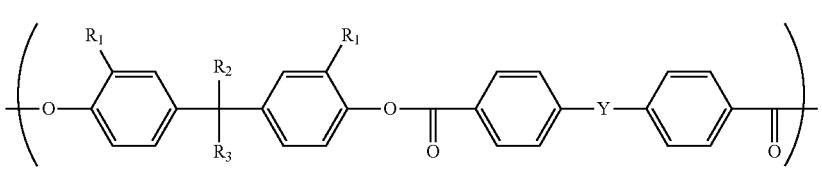

(I)

In general formula (I), $R_1$ represents a hydrogen atom or an alkyl group having a carbon number of at least 1 and no greater than 4. Further, $R_2$ and $R_3$ represent, independently of one another, a hydrogen atom or an alkyl group having a carbon number of at least 1 and no greater than 3. Furthermore, $R_2$ is different from $R_3$. Yet, Y represents a single bond or an oxygen atom.

DETAILED DESCRIPTION

Figure 1A:
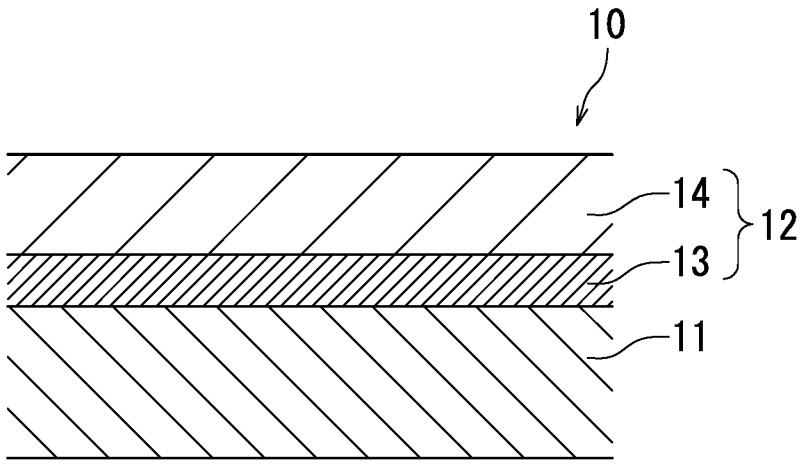
FIGS. 1A and 1B each are a schematic cross sectional view illustrating structure of a multi-layer electrophotographic photosensitive member according to an embodiment of the present embodiment.

The following provides detailed explanation of an embodiment of the present disclosure. However, the present disclosure is of course not limited by the embodiment and appropriate variations within the intended scope of the present disclosure can be made when implementing the present disclosure. Although explanation is omitted as appropriate in some instances in order to avoid repetition, such omission does not limit the essence of the present disclosure. Note that in the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

The terms an alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 1 and no greater than 3, an alkoxy group having a carbon number of at least 1 and no greater than 8, an alkoxy group having a carbon number of at least 1 and no greater than 6, a cycloalkane having a carbon number of at least 5 and no greater than 7, and an aryl group having a carbon number of at least 6 and no greater than 14 are defined as below.

The alkyl group having a carbon number of at least 1 and no greater than 8 is defined as a straight chain or branched non-substituent. Examples of possible alkyl groups having a carbon number of at least 1 and no greater than 8 include a methyl group, an ethyl group, a propyl group, an isopropyl group, an n-butyl group, an s-butyl group, a t-butyl group, a pentyl group, an isopentyl group, a neopentyl group, a hexyl group, a heptyl group, and an octyl group.

The alkyl group having a carbon number of at least 1 and no greater than 6 is defined as a straight chain or branched non-substituent. Examples of possible alkyl groups having a carbon number of at least 1 and no greater than 6 include a methyl group, an ethyl group, a propyl group, an isopropyl group, an n-butyl group, an s-butyl group, a t-butyl group, a pentyl group, an isopentyl group, a neopentyl group, and a hexyl group.

The alkyl group having a carbon number of at least 1 and no greater than 4 is defined as a straight chain or branched non-substituent. Examples of possible alkyl groups having a carbon number of at least 1 and no greater than 4 include a methyl group, an ethyl group, a propyl group, an isopropyl group, an n-butyl group, an s-butyl group, and a t-butyl group.

The alkyl group having a carbon number of at least 1 and no greater than 3 is defined as a straight chain or branched non-substituent. Examples of possible alkyl groups having a carbon number of at least 1 and no greater than 3 include a methyl group, an ethyl group, a propyl group, and an isopropyl group.

The alkoxy group having a carbon number of at least 1 and no greater than 8 is defined as a straight chain or branched non-substituent. Examples of possible alkoxy groups having a carbon number of at least 1 and no greater than 8 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, a hexyloxy group, a heptyloxy group, and an octyloxy group.

The alkoxy group having a carbon number of at least 1 and no greater than 6 is defined as a straight chain or branched non-substituent. Examples of possible alkoxy groups having a carbon number of at least 1 and no greater than 6 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

The cycloalkane having a carbon number of at least 5 and no greater than 7 is defined as a non-substituted cycloalkane having a carbon number of at least 5 and no greater than 7. Examples of possible cycloalkanes having a carbon number of at least 5 and no greater than 7 include cyclopentane, cyclohexane, and cycloheptane.

The aryl group having a carbon number of at least 6 and no greater than 14 is defined as for example an unsubstituted monocyclic aromatic hydrocarbon group having a carbon number of at least 6 and no greater than 14, an unsubstituted condensed bicyclic aromatic hydrocarbon group having a carbon number of at least 6 and no greater than 14, or an unsubstituted condensed tricyclic aromatic hydrocarbon group having a carbon number of at least 6 and no greater than 14. Examples of possible aryl groups having a carbon number of at least 6 and no greater than 14 include a phenyl group, a naphthyl group, an anthryl group, and a phenanthryl group.

<Photosensitive Member>

Figure 1B:
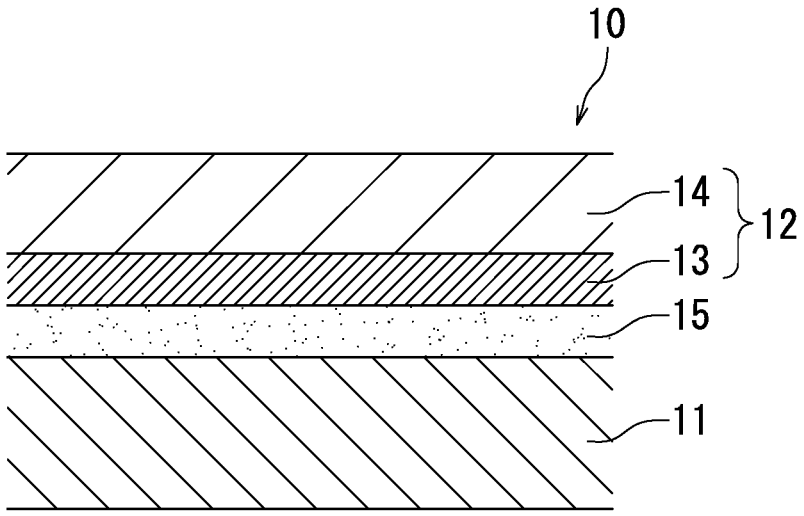

A multi-layer electrophotographic photosensitive member according to the present disclosure (also referred to below as a photosensitive member) includes a photosensitive layer. Following describes structure of a photosensitive member 10 according to the present embodiment with reference to FIGS. 1A and 1B. FIGS. 1A and 1B each are a schematic cross sectional view illustrating structure of the photosensitive member 10. As illustrated in FIG. 1A, the photosensitive member 10 includes a conductive substrate 11 and a photosensitive layer 12. The photosensitive layer 12 includes a charge generating layer 13 and a charge transport layer 14. As illustrated in FIG. 1A, the charge transport layer 14 is disposed as an outermost surface layer of the photosensitive member 10. The charge transport layer 14 is a monolayer (single layer).

As illustrated in FIG. 1A, the photosensitive layer 12 may be disposed directly on the conductive substrate 11. Alternatively, as illustrated in FIG. 1B, the photosensitive member 10 includes an intermediate layer 15 (undercoat layer) in addition to the conductive substrate 11 and the photosensitive layer 12. As illustrated in FIG. 1B, the photosensitive layer 12 may be disposed indirectly on the conductive substrate 11. As illustrated in FIG. 1B, the intermediate layer 15 may be disposed between the conductive substrate 11 and the charge generating layer 13. Alternatively, the intermediate layer 15 may be disposed between the charge generating layer 13 and the charge transport layer 14, for example.

The charge transport layer 14 is a monolayer (single layer) and contains specific components described later. Provision of the charge transport layer 14 as the outermost surface layer can improve abrasion resistance of the photosensitive member 10. Note that the charge generating layer 13 may be a monolayer or a multi-layer.

The structure of the photosensitive member 10 according to the present embodiment has been described so far with reference to FIGS. 1A and 1B. Description will be made next about elements (the conductive substrate 11, the photosensitive layer 12, and the intermediate layer 15) of the photosensitive member 10 according to the present embodiment. A photosensitive member producing method will be described in addition.

[1. Conductive Substrate]

No particular limitation is placed on the conductive substrate other than being a conductive substrate that can be use in a photosensitive member. One example of conductive substrates that can be used is a conductive substrate at least a surface portion of which is made from a conductive material. Other examples of conductive substrates that can be used include a conductive substrate made from a conductive material and a conductive substrate covered with a conductive material. Examples of possible conductive materials include aluminum, iron, copper, tin, platinum, silver, vanadium, molybdenum, chromium, cadmium, titanium, nickel, palladium, and indium. Any one of the conductive materials listed above may be used, or a combination of two or more on the conductive materials listed above may be used. Examples of combinations of two or more of the conductive materials listed above include alloys (specific examples include an aluminum alloy, stainless steel, and brass).

Among the conductive materials listed above, aluminum or an aluminum alloy is preferable in terms of excellent charge mobility from the photosensitive layer to the conductive substrate.

The shape of the conductive substrate can be appropriately selected in accordance with the structure of an image forming apparatus in which the conductive substrate is to be used. The conductive substrate has a sheet shape or a drum shape, for example. The thickness of the conductive substrate can be selected appropriately in accordance with the shape of the conductive substrate.

[2. Photosensitive Layer]

As already described, the photosensitive layer includes the charge generating layer and the charge transport layer. The photosensitive layer may optionally contain an additive. The charge generating layer and the charge transport layer will be described below. The additive will be described in addition.

[2-1. Charge Generating Layer]

The charge generating layer contains a charge generating material and a charge generating layer binder resin (also referred to below as a base resin). No particular limitation is placed on the thickness of the charge generating layer as long as the thickness thereof is sufficient to enable the charge generating layer to work. The thickness of the charge generating layer is preferably at least 0.01 μm and no greater than 5 and more preferably at least 0.1 μm and no greater than 3 μm. The charge generating material and the base resin will be described below.

[2-1-1. Charge Generating Material]

No particular limitation is placed on the charge generating material other than being a charge generating material that can be used in a photosensitive member. Examples of charge generating materials that can be used include phthalocyanine-based pigments, perylene-based pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, selenium, selenium-tellurium, selenium-arsenic, cadmium sulfide, powders of inorganic photoconductive materials such as amorphous silicon, pyrylium salt, anthanthrone-based pigments, triphenylmethane-based pigments, threne-based pigments, toluidine-based pigments, pyrazoline-based pigments, and quinacridone-based pigments. Examples of phthalocyanine-based pigments that can be used include phthalocyanines and derivatives of phthalocyanines. Examples of phthalocyanines that can be used include metal-free phthalocyanine pigments (specific examples include X-form metal-free phthalocyanine (x-$H_2$Pc)). Examples of derivatives of phthalocyanines that can be used include metal phthalocyanine pigments (specific examples include titanyl phthalocyanine and V-form hydroxygallium phthalocyanine). No particular limitation is placed on crystal structure of the phthalocyanine-based pigments, and phthalocyanine-based pigments having various crystal forms can be used. Examples of crystal forms of phthalocyanine pigments include α-form, β-form, and Y-form. One of the charge generating materials listed above may be used, or a combination of two or more of the charge generating materials listed above can be used.

One of charge generating materials having an absorption wavelength in a desired range may be used, or two or more of such charge generating materials may be used in combination. A photosensitive member having sensitivity in a wavelength range of at least 700 nm is preferably used in digital optical image forming apparatuses, for example. For this reason, a phthalocyanine-based pigment is preferable and an X-form metal-free phthalocyanine (x-$H_2$Pc) or a Y-form titanyl phthalocyanine (Y-TiOPc) is further preferable. Examples of digital optical image forming apparatuses include a laser beam printer and a facsimile machine that use a semiconductor laser as a light source.

An anthanthrone-based pigment or a perylene-based pigment is preferably used as a charge generating material in a photosensitive member used in an image forming apparatus provided with a short-wavelength laser light source. The short-wavelength laser has a wavelength of at least 350 nm and no greater than 550 nm, for example.

Examples of charge generating materials that can be used include phthalocyanine-based pigments represented by chemical formulas (CGM-1)-(CGM-4) (also referred to below as charge generating materials (CGM-1)-(CGM-4), respectively) shown below.

(CGM-1)

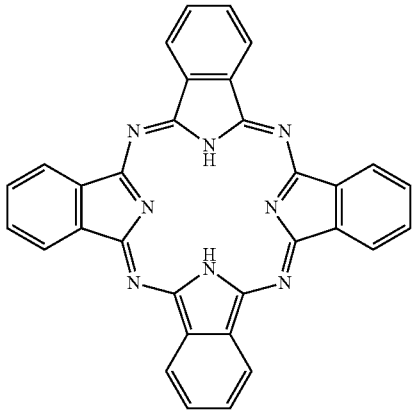

(CGM-2)

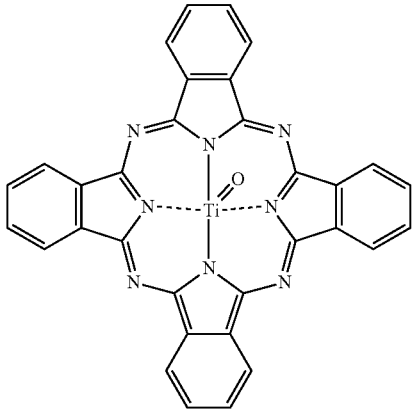

(CGM-3)

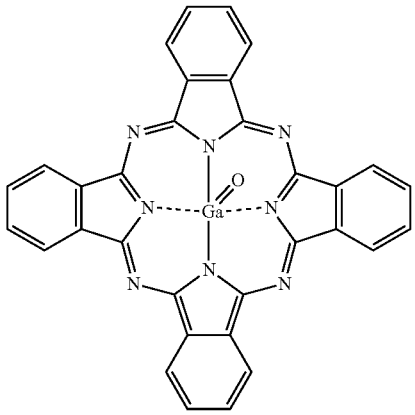

-continued (CGM-4)

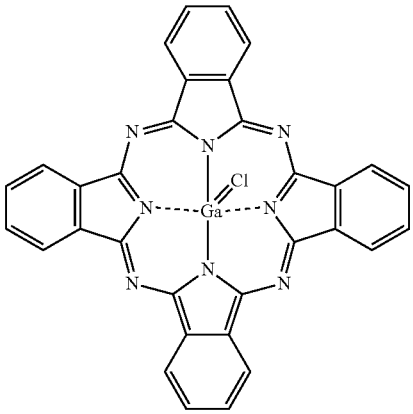

The charge generating material has a content of at least 5 parts by mass and no greater than 1,000 parts by mass relative to 100 parts by mass of the base resin, and more preferably at least 30 parts by mass and no greater than 500 parts by mass.

[2-1-2. Base Resin]

No particular limitation is placed on the base resin other than being a base resin that can be used in a photosensitive member. Examples of base resins that can be used include thermoplastic resins, thermosetting resins, and photocurable resins. Examples of thermoplastic resins that can be used include styrene-based resins, styrene-butadiene copolymers, styrene-acrylonitrile copolymers, styrene-maleate copolymers, styrene-acrylic acid-based copolymers, acrylic copolymers, polyethylene resins, ethylene-vinyl acetate copolymers, chlorinated polyethylene resins, polyvinyl chloride resins, polypropylene resins, ionomer, vinyl chloride-vinyl acetate copolymers, alkyd resins, polyamide resins, urethane resins, polycarbonate resins, polyarylate resins, polysulfone resins, diallyl phthalate resins, ketone resins, polyvinyl butyral resins, polyether resins, and polyester resins. Examples of thermosetting resins that can be used include silicone resins, epoxy resins, phenolic resins, urea resins, melamine resin, and other crosslinkable thermosetting resins. Examples of photocurable resins that can be used include epoxy acrylic acid-based resins and urethane-acrylic acid-based resins. One of the resins listed above may be used, or a combination of two or more of the resins listed above can be used.

Examples of base resin that can be used are the same as those listed below as examples of binder resins. However, a resin different from the binder resin is typically selected as the base resin in the same photosensitive member. The reason thereof is as follows. In a situation in which the photosensitive member is produced, typically, the charge generating layer is formed first and the charge transport layer is then formed. Specifically, an application liquid for charge transport layer formation is applied onto the charge generating layer. As such, the charge generating layer is required to be insoluble in a solvent of the application liquid for charge transport layer formation in formation of the charge transport layer. In view of the foregoing, a base resin and a binder resin included in the same photosensitive member 1 are selected so as to be different from one another.

[2-2. Charge Transport Layer]

The charge transport layer contains a charge transport material, a binder resin, and silica particles. No particular limitation is placed on the thickness of the charge transport layer as long as the thickness thereof is sufficient to enable the charge transport layer to work. The thickness of the charge transport layer is preferably at least 2 μm and no greater than 100 μm, and more preferably at least 5 μm and no greater than 50 μm. The charge transport layer may optionally contain a pigment. The charge transport layer, the binder resin, and the silica particles will be described below. Description about the pigment will be also made below.

[2-2-1. Charge Transport Material]

The charge transport material (particularly, a hole transport material) preferably contains a compound including two or more styryl groups and one or more aryl group groups. Examples of hole transport materials that can be used include compounds represented by general formulas (II), (III), (IV), and (V). Containment of any of the compounds represented by general formula (II)-(V) in the charge transport layer contains can improve abrasion resistance of the photosensitive member. The hole transport material preferably contains a compound represented by general formula (II), (III), or (V) in order to improve electrical characteristics of the photosensitive member in addition to abrasion resistance of the photosensitive member. Further preferably, the hole transport material contains a compound represented by general formula (II) or (V) in order to improve resistance to oil crack of the photosensitive member in addition to abrasion resistance and electrical characteristics of the photosensitive member.

(II)

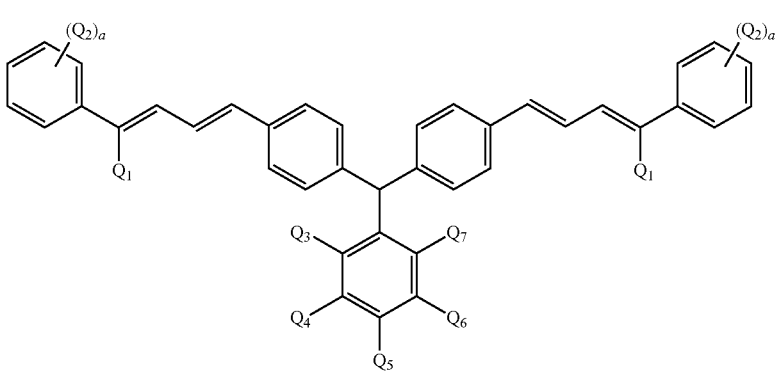

In general formula (II), $Q_1$ represents a hydrogen atom, an alkyl group having a carbon number of at least 1 and no greater than 8, an alkoxy group having a carbon number of at least 1 and no greater than 8, or a phenyl group optionally substituted with an alkyl group having a carbon number of at least 1 and no greater than 8. Each of two chemical groups $Q_1$ may be the same or different from one another. Further, $Q_2$ represents an alkyl group having a carbon number of at least 1 and no greater than 8, an alkoxy group having a carbon number of at least 1 and no greater than 8, or a phenyl group. Yet, $Q_3$, $Q_4$, $Q_5$, $Q_6$, and $Q_7$ represent, independently of one another, a hydrogen atom, an alkyl group having a carbon number of at least 1 and no greater than 8, an alkoxy group having a carbon number of at least 1 and no greater than 8, or a phenyl group. Any adjacent two of $Q_3$, $Q_4$, $Q_5$, $Q_6$, and $Q_7$ may be bonded together to form a ring. Still, a represents an integer of at least 0 and no greater than 5. When a represents an integer of at least 2 and no greater than 5, each $Q_2$ bonded to the same phenyl group may be the same or different from one another.

(IV)

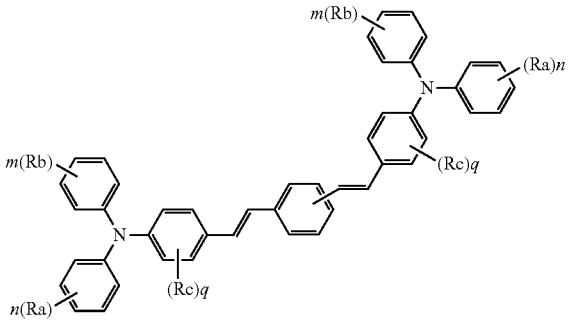

[Formula7]

(III)

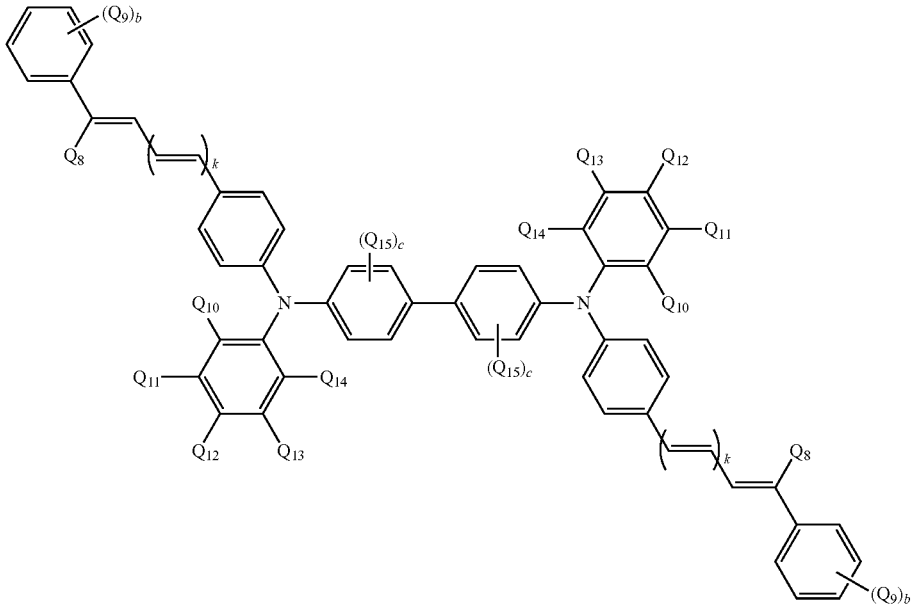

In general formula (III), $Q_8$, $Q_{10}$, $Q_{11}$, $Q_{12}$, $Q_{13}$, and $Q_{14}$ represent, independently of one another, a hydrogen atom, an alkyl group having a carbon number of at least 1 and no greater than 8, an alkoxy group having a carbon number of at least 1 and no greater than 8, or a phenyl group. Further, $Q_9$ and $Q_{15}$ represent, independently of one another, an alkyl group having a carbon number of at least 1 and no greater than 8, an alkoxy group having a carbon number of at least 1 and no greater than 8, or a phenyl group. Yet, b represents an integer of at least 0 and no greater than 5. When b represents an integer of at least 2 and no greater than 5, each $Q_9$ bonded to the same phenyl group may be the same or different from one another. Still, c represents an integer of at least 0 and no greater than 4. When c represents an integer of at least 2 and no greater than 4, each $Q_{15}$ bonded to the same phenyl group may be the same or different from one another. Yet, k represents 0 or 1.

In general formula (IV), $R_a$, $R_b$, and $R_c$ represent, independently of one another, a hydrogen atom, an alkyl group having a carbon number of at least 1 and no greater than 8, a phenyl group, or an alkoxy group having a carbon number of at least 1 and no greater than 8. Still, q represents an integer of at least 0 and no greater than 4. When q represents an integer of at least 2 and no greater than 4, each $R_c$ bonded to the same phenyl group may be the same or different from one another. Still, m and n represent, independently of one another, an integer of at least 0 and no greater than 5. When m represents an integer of at least 2 and no greater than 5, each $R_b$ bonded to the same phenyl group may be the same or different from one another. When n represents an integer of at least 2 and no greater than 5, each $R_a$ bonded to the same phenyl group may be the same or different from one another.

(V)

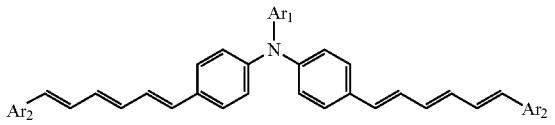

In general formula (V), $Ar_1$ represents an aryl group optionally substituted with one or more substituents selected from the group consisting of an alkyl group having a carbon number of at least 1 and no greater than 6, a phenoxy group, and an alkoxy group having a carbon number of at least 1 and no greater than 6, or a heterocyclic group optionally substituted with one or more substituents selected from the group consisting of an alkyl group having a carbon number of at least 1 and no greater than 6, a phenoxy group, and an alkoxy group having a carbon number of at least 1 and no greater than 6. Further, $Ar_2$ represents an aryl group optionally substituted with one or more one substituents selected from the group consisting of an alkyl group having a carbon number of at least 1 and no greater than 6, a phenoxy group, and an alkoxy group having a carbon number of at least 1 and no greater than 6.

In general formula (II), a phenyl group represented by $Q_1$ is preferably a phenyl group substituted with an alkyl group having a carbon number of at least 1 and no greater than 8, and more preferably a phenyl group substituted with a methyl group.

In general formula (II), an alkyl group having a carbon number of at least 1 and no greater than 8 that is represented by $Q_2$ is preferably an alkyl group having a carbon number of at least 1 and no greater than 6, more preferably an alkyl group having a carbon number of at least 1 and no greater than 4, and further preferably a methyl group. Further, a preferably represents 0 or 1.

In general formula (II), an alkyl group having a carbon number of at least 1 and no greater than 8 that is represented by $Q_3$-$Q_7$ is preferably an alkyl group having a carbon number of at least 1 and no greater than 4, and more preferably a methyl group, an ethyl group, or an n-butyl group. In general formula (II), an alkoxy group having a carbon number of at least 1 and no greater than 8 that is represented by $Q_3$-$Q_7$ is preferably a methoxy group. In general formula (II), $Q_3$-$Q_7$ preferably represent, independently of one another, a hydrogen atom, an alkyl group having a carbon number of at least 1 and no greater than 8, or an alkoxy group having a carbon number of at least 1 and no greater than 8, and more preferably a hydrogen atom, an alkyl group having a carbon number of at least 1 and no greater than 4, or a methoxy group.

In general formula (II), any adjacent two of $Q_3$-$Q_7$ may be bonded together to form a ring (specifically, a benzene ring or a cycloalkane having a carbon number of at least 5 and no greater than 7). For example, adjacent chemical groups $Q_6$ and $Q_7$ among $Q_3$-$Q_7$ may be bonded together to form a benzene ring or a cycloalkane having a carbon number of at least 5 and no greater than 7. In a configuration in which any adjacent two of $Q_3$-$Q_7$ are bonded together to form a benzene ring, the benzene ring is condensed with a phenyl group to which any of $Q_3$-$Q_7$ is bonded to form a fused bi-cyclic group (naphthyl group). In a configuration in which any adjacent two of $Q_3$-$Q_7$ are bonded together to form a cycloalkane having a carbon number of at least 5 and no greater than 7, the cycloalkane having a carbon number of at least at least 5 and no greater than 7 is condensed with a phenyl group to which any of $Q_3$-$Q_7$ is bonded to form a fused bi-cyclic group. In the above configuration, a condensed portion of the cycloalkane having a carbon number of at least 5 and no greater than 7 with the phenyl group may have a double bond. Preferably, any adjacent two of $Q_3$-$Q_7$ are bonded together to form a cycloalkane having a carbon number of at least 5 and no greater than 7, and more preferably to form cyclohexane.

In general formula (II), $Q_1$ preferably represents a hydrogen atom or a phenyl group substituted with an alkyl group having a carbon number of at least 1 and no greater than 8. Preferably, $Q_2$ represents an alkyl group having a carbon number of at least 1 and no greater than 8. Preferably, $Q_3$-$Q_7$ represent, independently of one another, a hydrogen atom, an alkyl group having a carbon number of at least 1 and no greater than 8, or an alkoxy group having a carbon number of at least 1 and no greater than 8. Any adjacent two of $Q_3$-$Q_7$ are preferably bonded to form a ring. Preferably, a represents 0 or 1.

In general formula (III), an alkyl group having a carbon number of at least 1 and no greater than 8 that may be represented by $Q_8$ and $Q_{10}$-$Q_{14}$ is preferably an alkyl group having a carbon number of at least 1 and no greater than 4, and more preferably a methyl group or an ethyl group. In general formula (III), preferably, $Q_8$ and $Q_{10}$-$Q_{14}$ represent, independently of one another, a hydrogen atom, an alkyl group having a carbon number of at least 1 and no greater than 4, or a phenyl group. In general formula (III), b and c preferably represent 0.

In general formula (IV), an alkyl group having a carbon number of at least 1 and no greater than 8 that may be represented by $R_a$ and $R_b$ is preferably an alkyl group having a carbon number of at least 1 and no greater than 4, and more preferably a methyl group or an ethyl group. Further, m and n represent, independently of one another, an integer of at least 0 and no greater than 2. Preferably, q represents 0.

In general formula (V), an aryl group that may be represented by $Ar_1$ may be an aryl group having a carbon number of at least 6 and no greater than 14. In general formula (V), an aryl group that may be represented by $Ar_1$ may have a substituent. The substituent of the aryl group is selected from the group consisting of an alkyl group having a carbon number of at least 1 and no greater than 6, a phenoxy group, and an alkoxy group having a carbon number of at least 1 and no greater than 6. In general formula (V), an aryl group that may be represented by $Ar_1$ is preferably a phenyl group substituted with an alkyl group having a carbon number of at least 1 and no greater than 4, and more preferably a phenyl group substituted with a methyl group or an ethyl group. In general formula (V), an aryl group that may be represented by $Ar_2$ is preferably a phenyl group.

Examples of heterocyclic groups that can be represented by $Ar_1$ in general formula (V) include: an aromatic five- or six-member monocyclic heterocyclic group including one or more (preferably at least 1 and no greater than 3) hetero atoms; a heterocyclic group in which monocyclic rings as above are condensed with one another; and a heterocyclic group in which a monocyclic ring as above is condensed with a five- or six-number hydrocarbon ring. The hetero atom is at least one selected from the group consisting of a nitrogen atom, a sulfur atom, and an oxygen atom. Examples of possible heterocyclic groups include a thiophenyl group, a furanyl group, a pyrrolyl group, an imidazolyl group, a pyrazolyl group, an isothiazolyl group, an isoxazolyl group, an oxazolyl group, a thiazolyl group, a furazanyl group, a pyranyl group, a pyridyl group, a pyridazinyl group, a pyrimidinyl group, a pyrazinyl group, an indolyl group, a quinolinyl group, an isoquinolinyl group, a purinyl group, a pteridinyl group, a benzofuranyl group, and a benzimidazolyl group. In general formula (V), a heterocyclic group that may be represented by $Ar_1$ may have a substituent. The substituent of the heterocyclic group is selected from the group consisting of an alkyl group having a carbon number of at least 1 and no greater than 6, a phenoxy group, and an alkoxy group having a carbon number of at least 1 and no greater than 6.

Specific examples of hole transport materials that can be used include compounds represented by chemical formulas (CTM-1)-(CTM-10) (also referred to below as charge transport materials (CTM-1)-(CTM-10), respectively). The charge transport materials (CTM-1)-(CTM-4) each are a specific example of compounds represented by general formula (II). The charge transport materials (CTM-5)-(CTM-7) each are a specific example of compounds represented by general formula (III). The charge transport materials (CTM-8) and (CTM-9) each are a specific example of compounds represented by general formula (IV). The charge transport material (CTM-10) is a specific example of compounds represented by general formula (V).

(CTM-1)

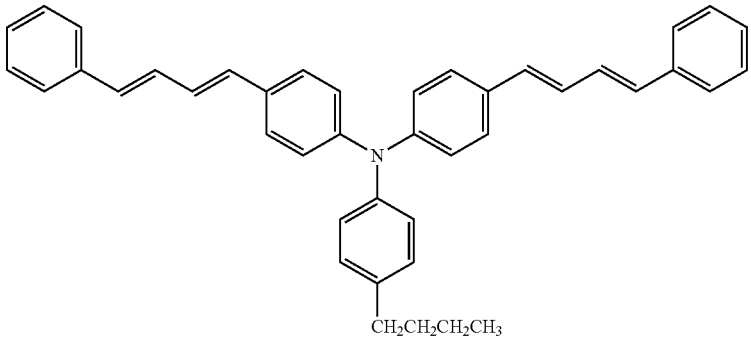

(CTM-2)

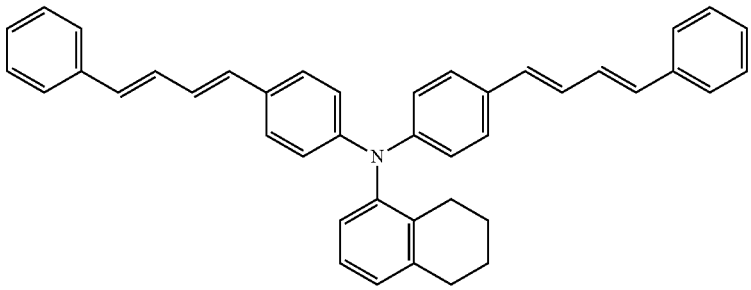

(CTM-3)

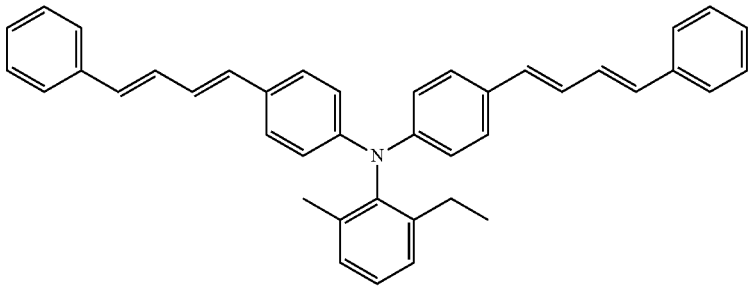

(CTM-4)

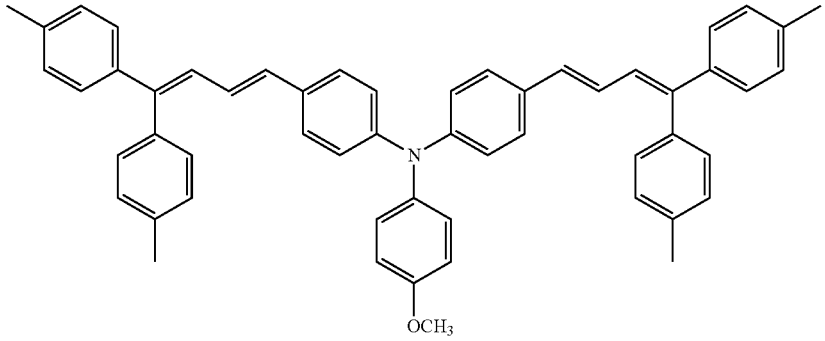

-continued
(CTM-5)
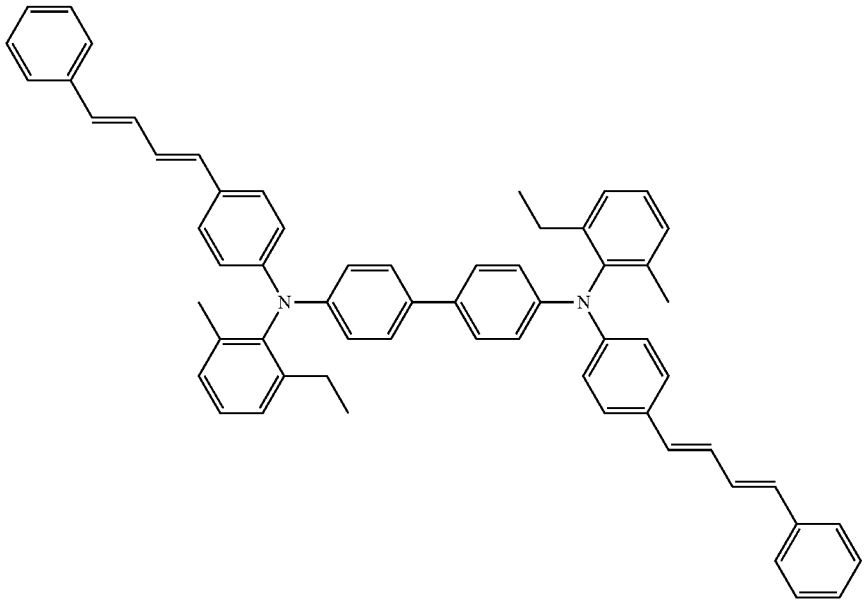
(CTM-6)
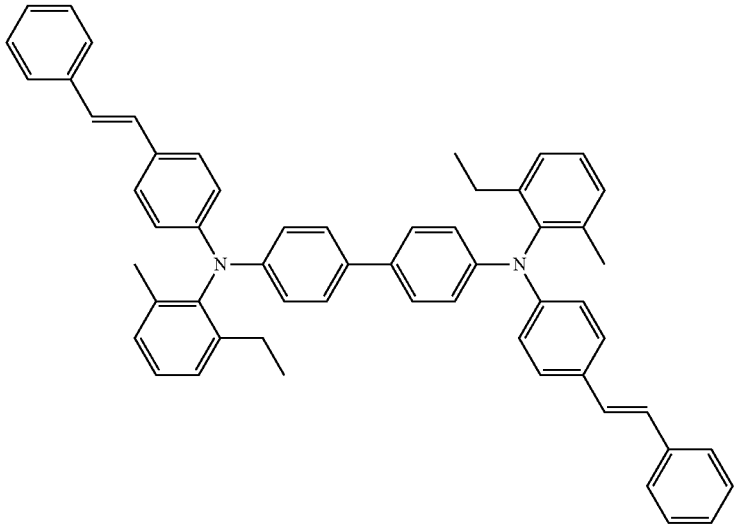
(CTM-7)
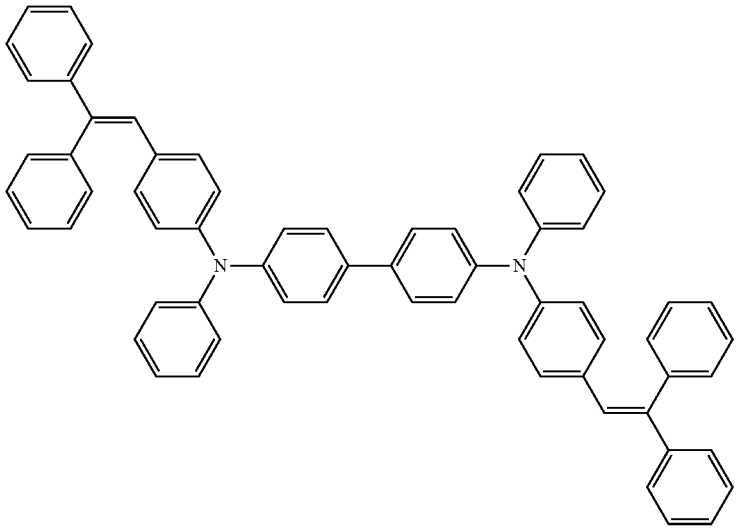

-continued (CTM-8)

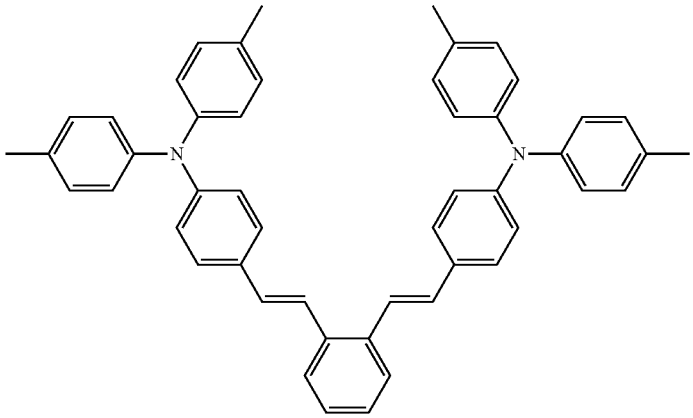

(CTM-9)

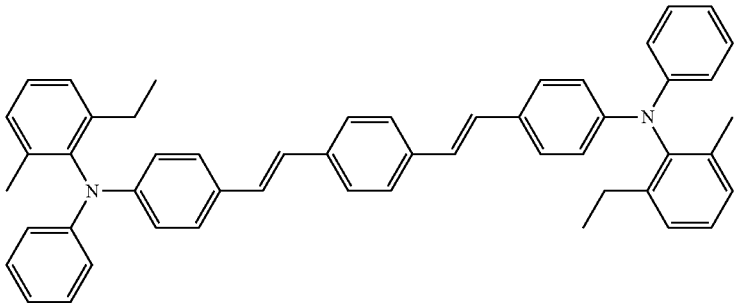

(CTM-10)

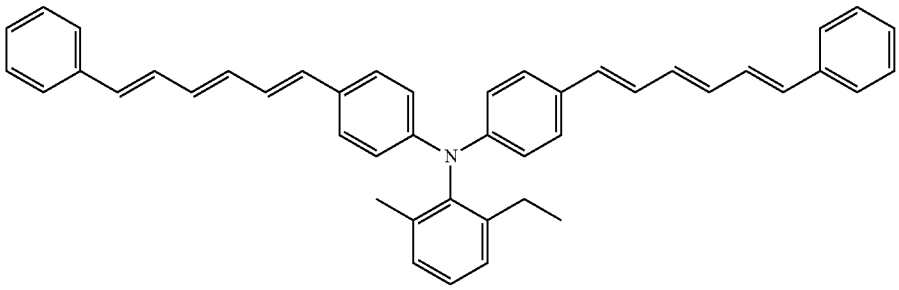

The hole transport material may be a compound other than the compounds represented by general formulas (II)-(V). Examples of hole transport material other than the compounds represented by general formulas (II)-(V) include nitrogen-containing cyclic compounds and condensed polycyclic compounds. Examples of nitrogen-containing cyclic compounds and condensed polycyclic compounds that can be used include: diamine derivatives (specific examples include an N,N,N',N'-tetraphenylphenylenediamine derivative, an N,N,N',N'-tetraphenylnaphtylenediamine derivative, and an N,N,N',N'-tetraphenylphenanthrylenediamine derivative); oxadiazole-based compounds (specific examples include 2,5-di(4-methylaminophenyl)-1,3,4-oxadiazole); styryl-based compounds (specific examples include 9-(4-diethylaminostyryl)anthracene); carbazole-based compounds (specific examples include polyvinyl carbazole); organic polysilane compounds; pyrazoline-based compounds (specific examples include 1-phenyl-3-(p-dimethylaminophenyl)pyrazoline); hydrazone-based compounds; indole-based compounds; oxadiazole-based compounds; isoxazole-based compounds; thiazole-based compounds; thiadiazole compounds; imidazole-based compounds; pyrazoline-based compounds; and triazole-based compounds.

The content of the hole transport material in the photosensitive member is preferably at least 10 parts by mass and no greater than 200 parts by mass relative to 100 parts by mass of the binder resin, and more preferably at least 20 parts by mass and no greater than 100 parts by mass.

[2-2-2. Binder Resin]

The binder resin is used in the charge transport layer of the photosensitive member. The binder resin includes a polyarylate resin represented by general formula (I) (also referred to below as a polyarylate resin (I)) shown below. Containment of the polyarylate resin (I) in the photosensitive member can improve abrasion resistance of the photosensitive member.

(I)

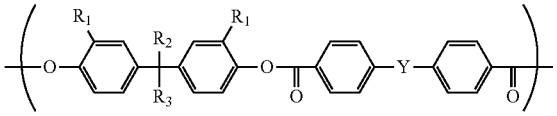

In general formula (I), $R_1$ represents a hydrogen atom or an alkyl group having a carbon number of at least 1 and no greater than 4. Further, $R_2$ and $R_3$ represent, independently of one another, a hydrogen atom or an alkyl group having a carbon number of at least 1 and no greater than 3. Further, $R_2$ is different from $R_3$. Yet, Y represents a single bond or an oxygen atom.

In general formula (I), two chemical groups $R_1$ may be the same or different from one another. In general formula (I), $R_1$ and $R_2$ preferably represent, independently of one another, a hydrogen atom or a methyl group. Preferably, $R_3$ represents an alkyl group having a carbon number of at least 1 and no greater than 3.

The molecular weight of the binder resin is preferably at least 30,000 in terms of a viscosity average molecular weight, more preferably greater than 40,000, and further preferably greater than 40,000 and no greater than 50,200. In a configuration in which the binder resin has a viscosity average molecular weight of at least 30,000, abrasion resistance of the binder resin can be increased and the charge transport layer is accordingly hard to abrade. Furthermore, in a configuration in which the binder resin has a viscosity average molecular weight of greater than 40,000, abrasion resistance can be further increased and oil crack resistance can be easily improved. By contrast, in a configuration in which the binder resin has a viscosity average molecular weight of at least 50,200, the binder resin can hardly dissolve in a solvent in formation of the charge transport layer, resulting in that the charge transport layer tends to be formed easily.

No particular limitation is placed on a method for producing the binder resin other than being a method that can produce the polyarylate resin (I). A possible production method is condensation polymerization of an aromatic dicarboxylic acid and an aromatic diol for forming a repeating unit of the polyarylate resin. No particular limitation is placed on synthesis of the polyarylate resin, and any known synthesis (specific examples include solution polymerization, melt polymerization, and interface polymerization) can be adopted.

The aromatic dicarboxylic acid has two phenolic hydroxyl groups. Examples of possible aromatic dicarboxylic acids include an aromatic dicarboxylic acid represented by general formula (I-1) shown below. In general formula (I-1), Y is the same as defined for Y in general formula (I).

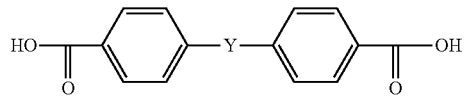

(I-1)

Examples of possible aromatic dicarboxylic acids include aromatic dicarboxylic acids having two carboxyl groups bonded to an aromatic ring (specific examples include terephthalic acid, isophthalic acid, 4,4'-dicarboxydiphenyl ether, 4,4'-dicarboxybiphenyl, and 2,6-naphthalene dicarboxylic acid). Note that in a situation in which the polyallylate resin (I) is synthesized, a derivative such as acid dichloride, dimethyl ester, or diethyl ester may be used instead of the aromatic dicarboxylic acid.

Examples of possible aromatic diols include an aromatic diol represented by general formula (I-2) shown below. In general formula (I-2), $R_1$, $R_2$, and $R_3$ are the same as defined for $R_1$, $R_2$, and $R_3$ in general formula (I), respectively.

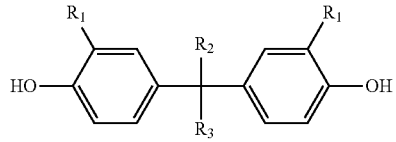

(I-2)

Examples of possible aromatic diols include bisphenols (specific examples include bisphenol A, bisphenol B, bisphenol S, bisphenol E, and bisphenol F). In a situation in which the polyallylate resin is synthesized, a derivative such as diacetate may be used instead of the aromatic diol.

Examples of the polyarylate resin (I) include polyarylate resins having a repeating units represented by any of chemical formulas (Resin-1)-(Resin-6) (also referred to below as polyarylate resins (Resin-1)-(Resin-6), respectively) shown below.

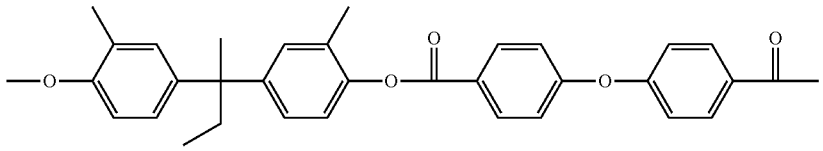

(Resin-1)

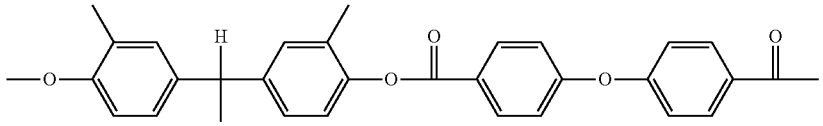

(Resin-2)

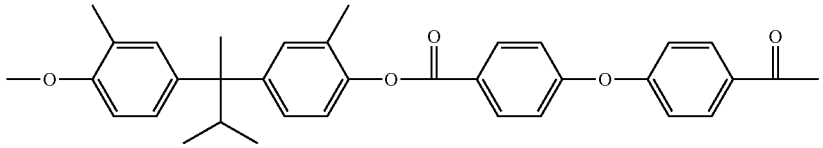

(Resin-3)

-continued

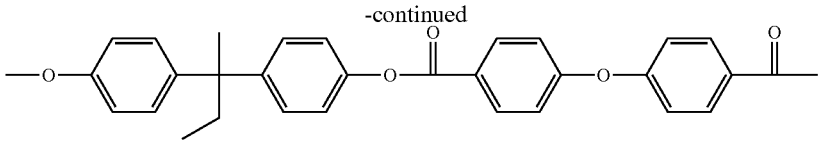

(Resin-4)

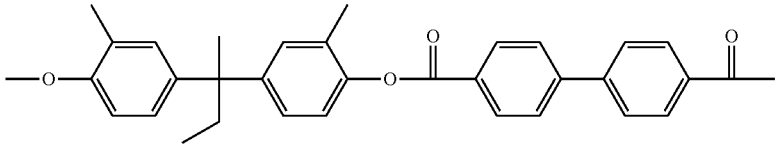

(Resin-5)

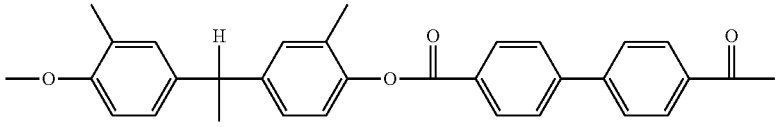

(Resin-6)

The polyarylate resin (I) may be used alone as the binder resin used in the present embodiment, or one or more resins other than the polyarylate resin (I) (other resins) may be used as the binder resin within a range not impairing the effect of the present disclosure. Examples of possible other resins include thermoplastic resins (specific examples include polyarylate resins other than the polyarylate resin (I), polycarbonate resins, styrene-based resins, styrene-butadiene copolymers, styrene-acrylonitrile copolymers, styrene-maleate copolymers, styrene-acrylate copolymers, acrylic copolymers, polyethylene resins, ethylene-vinyl acetate copolymers, chlorinated polyethylene resins, polyvinyl chloride resins, polypropylene resins, ionomer, vinyl chloride-vinyl acetate copolymers, polyester resins, alkyd resins, polyamide resins, polyurethane resins, polysulfone resins, diallyl phthalate resins, ketone resins, polyvinyl butyral resins, polyether resins, and polyester resins), thermosetting resins (specific examples include silicone resins, epoxy resins, phenolic resins, urea resins, melamine resins, and other crosslinkable thermosetting resins), and photocurable resins (specific examples include epoxy acrylate resins and urethane-acrylate copolymers). Any one of the resins listed above may be used, or two or more of the resin listed above may be used.

The content of the polyarylate resin (I) in the charge transport layer is preferably at least 40% by mass and no greater than 80% by mass in the present embodiment.

[2-2-3. Silica Particles]

The charge transport layer of the photosensitive member according to the present embodiment contains the silica particles in order to improve abrasion resistance of the photosensitive layer. Specifically, the outermost surface layer of the photosensitive layer contains the silica particles. Use of the silica particles can more favorably improve abrasion resistance of the photosensitive layer than use of particles other than the silica particles (specific examples of the other particles include particles of zinc oxide, titanium oxide, tin oxide, antimony oxide, indium oxide, bismuth oxide, indium oxide to which tin is doped, tin oxide to which antimony or tantalum is doped, and zirconium oxide). Use of the silica particles can facilitate surface treatment and adjustment of particle diameters while achieving reduction in manufacturing cost.

The silica particles are preferably subjected to a surface treatment with a surface preparation agent in order to improve abrasion resistance. Examples of surface preparation agents that can be used include hexamethyldisilazane, N-methyl-hexamethyldisilazane, hexamethyl-N-propyl disilazane, dimethyldichlorosilane, and polydimethylsiloxane. Hexamethyldisilazane is particularly preferable as the surface preparation agent. The reason for hexamethyldisilazane being particularly preferable is as follows. A trimethylsilyl group that hexamethyldisilazane has a favorable reactivity with a hydroxyl group on the surfaces of the silica particles, and therefore, hexamethyldisilazane hardly reduce the hydroxyl group on the surfaces of the silica particles. As a result, degradation of electrical characteristics caused due to the presence of moisture (humidity) can be inhibited. Further, oil crack resistance can be improved.

Furthermore, use of hexamethyldisilazane as a surface preparation agent can inhibit separation of the surface preparation agent from the surfaces of the silica particles. Separate surface preparation agent may cause charge trap to reduce sensitivity. However, in the present embodiment, separation of the surface preparation agent from the surfaces of the silica particles can be inhibited through the use of hexamethyldisilazane to sufficiently inhibit reduction in sensitivity of the photosensitive member.

In a configuration in which the surfaces of the silica particles are subjected to a surface treatment with a surface preparation agent such as hexamethyldisilazane, the hydroxyl group on the surfaces of the silica particles are silylated such that the surfaces of the silica particles each have a portion represented by general formula (VI) shown below.

(VI)

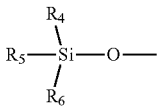

In general formula (VI), $R_4$, $R_5$, and $R_6$ represent, independently of one another, an alkyl group or an aryl group. Examples of an alkyl group that can be represented by $R_4$, $R_5$, and $R_6$ include an alkyl group having a carbon number of at least 1 and no greater than 6, with an alkyl group having a carbon number of at least 1 and no greater than 4 being preferable. Examples of aryl groups that can be represented by $R_4$, $R_5$, and $R_6$ include an aryl group having a carbon number of at least 6 and no greater than 14.

More preferably, $R_4$, $R_5$, and $R_6$ in general formula (VI) each represent a methyl group. Use of a chemical group such as above corresponds to use of hexamethyldisilazane as a surface preparation agent.

The content of the silica particles in the charge transport layer is preferably at least 0.5 parts by mass and no greater than 15 parts by mass relative to 100 parts by mass of the binder resin, and more preferably at least 1 part by mass and no greater than 10 parts by mass.

The silica particles preferably have a particle diameter (number-average primary particle diameter) of at least 7 nm and no greater than 100 nm, and more preferably at least 10 nm and no greater than 80 nm. In a configuration in which the silica particles have a number-average primary particle diameter of at least 7 nm, abrasion resistance can be easily improved. Furthermore, in a configuration in which the silica particles have a number-average primary particle diameter of no greater than 100 nm, dispersibility of the silica particles in the binder resin can hardly decrease. In a configuration in which the silica particles have a number-average primary particle diameter of at least 10 nm and no greater than 80 nm, abrasion resistance and oil crack resistance of the photosensitive member can be improved easily.

The number-average primary particle diameter of the silica particles can be measured by the following method. Silica (a plurality of powdery silica particles) is prepared as a measurement sample. An $N_2$ adsorption isotherm of the measurement sample at a temperature of −196° C. is measured. A measured $N_2$ adsorption isotherm is evaluated according to Brunauer, Emmett, and Teller (BET) method and t-curve method by De Boer. The specific surface area of the measurement sample is calculated from the above evaluation. The particle diameter of the measurement sample is calculated from the calculated specific surface area of the measurement sample according to an equation $S=6/\rho d$. In the equation: S represents a specific surface area of the measurement sample; ρ represents a density of the measurement sample; and d represents a particle diameter of the measurement sample. The calculated particle diameter of the measurement sample is defined as a number-average primary particle diameter of the silica particles. Another method for measuring a number-average primary particle diameter of the silica particles may be a method in which for example an image of the measurement sample is captured using a transmission electron microscope and the number-average primary particle diameter thereof is calculated from the captured image.

[2-2-4. Pigment]

Preferably, the charge transport layer further contains a pigment. Examples of pigments that can be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, anthanthrone-based pigments, triphenylmethane-based pigments, threne-based pigments, toluidine-based pigments, pyrazoline-based pigments, and quinacridone-based pigments. Examples of phthalocyanine-based pigments that can be used include metal-free phthalocyanine pigments (specific examples include an X-form metal-free phthalocyanine (x-$H_2$Pc) pigment), Y-form titanyl phthalocyanine (Y-TiOPc) pigments, α-form titanyl phthalocyanine (α-TiOPc) pigments, and ϵ-form copper phthalocyanine (ϵ-CuPc) pigments. Among the pigments listed above, a phthalocyanine-based pigment is preferable and a metal-free phthalocyanine is more preferable.

[2-3. Additive]

At least one of the photosensitive layer (the charge generating layer and charge transport layer) and the intermediate layer may contain various types of additives to the extent that such additives do not adversely affect electrophotographic properties of the photosensitive layer. Examples of additives that can be used include antidegradants (an antidegradant, a radical scavenger, a quencher, or a ultraviolet absorbing agent), softeners, surface modifiers, bulking agents, thickeners, dispersion stabilizers, waxes, electron acceptor compounds, donors, surfactants, sensitizers, plasticizers, and leveling agents. Among the additives listed above, a sensitizer, a plasticizer, an electron acceptor compound, and an antioxidant will be described.

[2-3-1. Sensitizer]

The charge generating layer may contain a sensitizer (for example, terphenyl, halonaphthoquinones, or acenaphthylene) that is an additive in order to increase sensitivity.

[2-3-2. Plasticizer]

The charge transport layer may contain a plasticizer that is an additive in order to improve oil crack resistance. Examples of plasticizers that can be used include biphenyl derivatives. Examples of biphenyl derivatives that can be used include respective compounds represented by chemical formulas (BP-1)-(BP-20) shown below.

(BP-1)

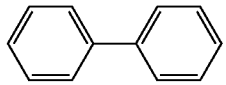

(BP-2)

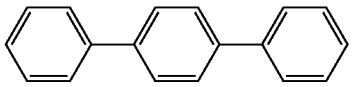

(BP-3)

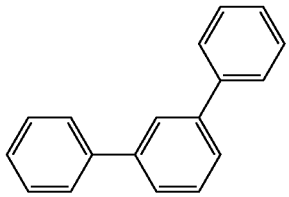

(BP-4)

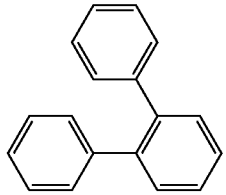

(BP-5)

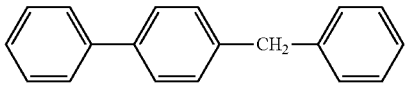

(BP-6)

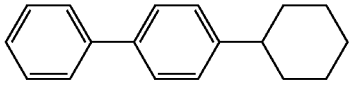

-continued (BP-7)

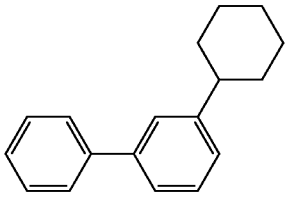

(BP-8)

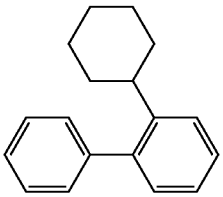

(BP-9)

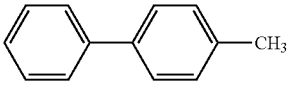

(BP-10)

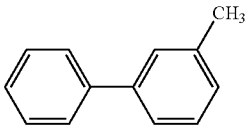

(BP-11)

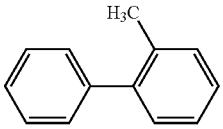

(BP-12)

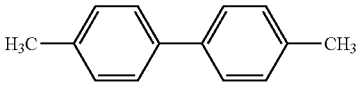

(BP-13)

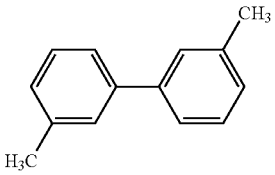

(BP-14)

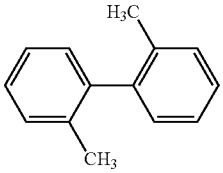

(BP-15)

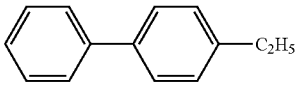

(BP-16)

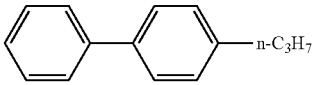

(BP-17)

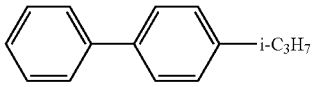

-continued (BP-18)

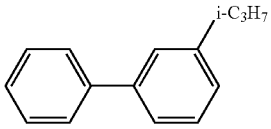

(BP-19)

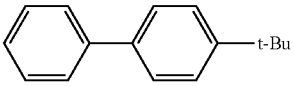

(BP-20)

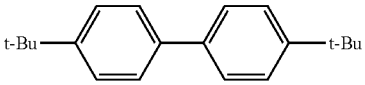

[2-3-3. Electron Acceptor Compound]

The photosensitive layer may contain an electron acceptor compound depending on necessity. Containment of an electron acceptor compound in the photosensitive layer of the photosensitive member can improve hole transportability of the hole transport material.

Examples of electron acceptor compounds that can be used include quinone-based compounds (specific examples include naphthoquinone-based compounds, diphenoquinone-based compounds, anthraquinone-based compounds, azoquinone-based compounds, nitroanthraquinone-based compounds, and dinitroanthraquinone-based compounds), malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroanthracene, dinitroacridine, succinic anhydride, maleic anhydride, and dibromomaleic anhydride. Any one of the electron acceptor compounds listed above can be used, or a combination of two or more of the electron acceptor compounds listed above can be used.

Among the electron acceptor compounds listed above, there are electron acceptor compounds represented by chemical formulas (EA-1)-(EA-8) (also referred to below as electron acceptor compounds (EA-1)-(EA-8), respectively) shown below.

(EA-1)

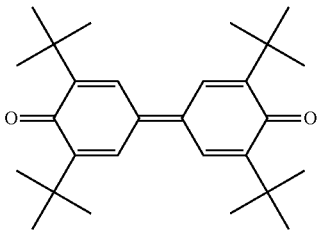

(EA-2)

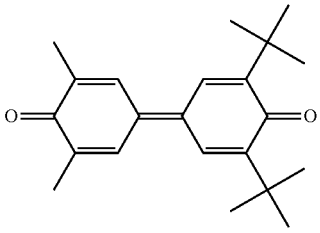

-continued (EA-3)

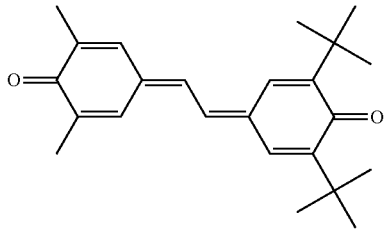

(EA-4)

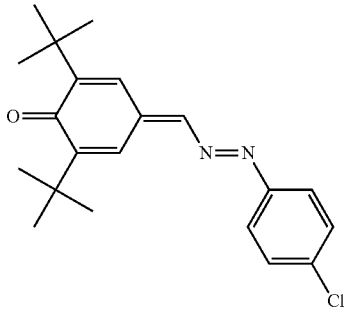

(EA-5)

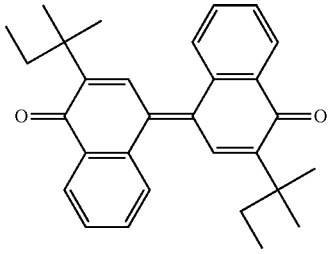

(EA-6)

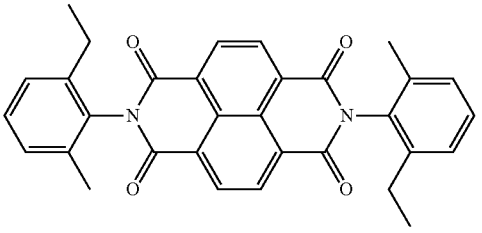

(EA-7)

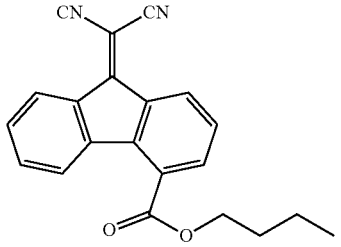

(EA-8)

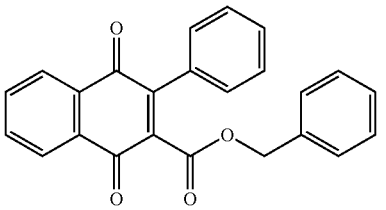

The content of the electron acceptor compound is preferably at least 0.1 parts by mass and no greater than 20 parts by mass relative to 100 parts by mass of the binder resin, and more preferably at least 0.5 parts by mass and no greater than 10 parts by mass.

[2-3-4. Antioxidant]

The charge transport layer may contain an antioxidant. Examples of antioxidant that can be used include hindered phenol-based compounds, hindered amine-based compounds, thioether-based compounds, and phosphite-based compounds. Among the antioxidants listed above, a hindered phenol-based compound or a hindered amine-based compound is preferable.

The additive amount of the antioxidant in the charge transport layer is preferably at least 0.1 parts by mass and no greater than 10 parts by mass relative to 100 parts by mass of the binder resin. In a configuration in which the additive amount of the antioxidant is in the above range, degradation of electric characteristics of the photosensitive member caused due to oxidation of the photosensitive member can be easily inhibited.

[3. Intermediate Layer]

The photosensitive member according to the present embodiment may include an intermediate layer (for example, an undercoat layer). The intermediate layer is disposed for example between the conductive substrate and the charge generating layer in the photosensitive member. The intermediate layer contains for example inorganic particles and a resin for intermediate layer use (intermediate layer resin). The presence of the intermediate layer between the conductive substrate and the charge generating layer can provide insulation to the extent of reducing leak current and still allow electric current to smoothly flow when the electrophotographic photosensitive member is exposed to light. This is effective to suppress increase in electric resistance.

Examples of inorganic particles that can be used include particles of metal (specifically aluminum, iron, or copper), particles of metal oxide (specifically, titanium oxide, alumina, zirconium oxide, tin oxide, or zinc oxide), and particles of non-metal oxide (specific examples include silica). Any one type of the inorganic particles listed above may be used, or a combination of two or more types of the inorganic particles listed above may be used.

No particular limitation is placed on the intermediate layer resin other than being a resin that can be used for intermediate layer use.

[4. Photosensitive Member Producing Method]

Following describes a photosensitive member producing method. The photosensitive member producing method involves a photosensitive layer formation process, for example. The photosensitive layer formation process includes a charge generating layer formation process and a charge transport layer formation process.

[4-1. Charge Generating Layer Formation Process]

In the charge generating layer formation process, an application liquid for forming a charge generating layer (also referred to below as an application liquid for charge generating layer formation) is prepared first. The application liquid for charge generating layer formation is applied onto a conductive substrate. Next, drying according to an appropriate method is performed for removing at least a part of a solvent contained in the applied application liquid for charge generating layer formation to form a charge generating layer. The application liquid for charge generating layer formation contains for example a charge generating material, a base resin, and the solvent. The application liquid for charge generating layer formation such as above is prepared by dispersing or dissolving the charge generating material in the solvent. The application liquid for charge generating layer formation may contain various types of additives depending on necessity.

[4-2. Charge Transport Layer Formation Process]

In the charge transport layer formation process, an application liquid for forming a charge transport layer (also referred to below as an application liquid for charge transport layer formation) is prepared first. The application liquid for charge transport layer formation is applied onto the charge generating layer. Next, drying according to an appropriate method is performed for removing at least a part of a solvent contained in the application liquid for charge transport layer formation to form a charge transport layer. The application liquid for charge transport layer formation contains the charge transport material, the polyarylate resin (I), silica particles, and the solvent. The application liquid for charge transport layer formation can be prepared by dissolving or dispersing the charge transport material, the polyarylate resin (I), and the silica particles in the solvent. The application liquid for charge transport layer formation may contain various types of additives depending on necessity.

Following describes the charge generating layer formation process and the charge transport layer formation process in detail.

No particular limitation is placed on the respective solvents contained in the application liquid for charge generating layer formation and the application liquid for charge transport layer formation other than respective solvents of the application liquid for charge generating layer formation and the application liquid for charge transport layer formation that can dissolve or disperse components contained therein. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. One of the solvents listed above may be used, or a combination of two or more of the solvents listed above can be used. Among the solvents listed above, a non-halogenated solvent is preferably used.

Furthermore, the solvent contained in the application liquid for charge transport layer formation is preferably different from the solvent contained in the application liquid for charge generating layer formation. In a situation in which the photosensitive member is produced, typically, the charge generating layer is formed first and the charge transport layer is then formed. Specifically, an application liquid for charge transport layer formation is applied onto the charge generating layer. As such, the charge generating layer is required to be insoluble in the solvent of the application liquid for charge transport layer formation in formation of the charge transport layer.

The application liquid for charge generating layer formation and the application liquid for charge transport layer formation each are prepared by mixing the corresponding components for dispersion in the corresponding solvent. For example, a bead mill, a roll mill, a ball mill, an attritor, a paint shaker, or a ultrasonic disperser can be used for mixing or dispersion.

The application liquid for charge generating layer formation and the application liquid for charge transport layer formation may each contain for example a surfactant or a leveling agent in order to improve dispersibility of the respective components or surface smoothness of the formed layers.

No particular limitation is placed on a method for applying the application liquid for charge generating layer formation or the application liquid for charge transport layer formation as long as being a method by which the application liquid for charge generating layer formation or the application liquid for charge transport layer formation can be applied uniformly. Examples of application methods that can be adopted include dip coating, spray coating, spin coating, and bar coating.

No particular limitation is placed on a method for removing at least a part of the solvent contained in the application liquid for charge generating layer formation or the application liquid for charge transport layer formation as long as being a method by which a part of the solvent contained in the application liquid for charge generating layer formation or the application liquid for charge transport layer formation can be removed (specifically, evaporated or the like). Examples of removal methods that can adopted include heating, pressure reduction, and a combination of heating and pressure reduction. Specific examples of heating include a heat treatment (hot-air drying) using a high-temperature dryer or a vacuum dryer. The heat treatment is for example performed for at least 3 minutes and no greater than 120 minutes at a temperature of at least 40° C. and no greater than 150° C.

Note that the photosensitive member producing method may involve an intermediate layer formation process depending on necessity. Any known method can be appropriately selected for the intermediate layer formation process.

The electrophotographic photosensitive member according to the present disclosure described above, which is excellent in abrasion resistance and oil crack resistance, can maintain excellent electrical characteristics, and therefore, can be applied to various types of image forming apparatuses.

EXAMPLES

The following provides more specific explanation of the present disclosure through examples. Note that the present disclosure is not in any way limited by the following examples.

Production of Photosensitive Member

[Photosensitive Member (A-1)]

Following describes production of a photosensitive member (A-1) according to Example 1.

(Formation of Intermediate Layer)

First, titanium oxide having been subjected to a surface treatment (SMT-A (trial product) manufactured by Tayca Corporation, number-average primary particle diameter 10 nm) was prepared. Specifically, after being subjected to a surface treatment with alumina and silica, the titanium oxide was further surface treated with methyl hydrogen polysiloxane during wet dispersion. Subsequently, 2 parts by mass of the surface treated titanium oxide and 1 part by mass of Amilan (registered Japanese trademark) CM8000 (product of Toray Industries, Inc., a quartercopolyamide resin of polyamide 6, polyamide 12, polyamide 66, and polyamide 610) that was a polyamide resin were added to a solvent containing 10 parts by mass of methanol, 1 part by mass of butanol, and 1 part by mass of toluene. Mixing was performed for five hours using a bead mill for dispersing the materials in the solvent. Through the above, an application liquid for intermediate layer formation was prepared.

The prepared application liquid for intermediate layer formation was filtered using a filter having an opening of 5 μm. The resultant application liquid for intermediate layer formation was subsequently applied onto a conductive support—an aluminum drum-shaped support having a diameter of 30 mm and a total length of 246 mm—by dip coating. The applied application liquid for intermediate layer formation was then subjected to heat treatment for 30 minutes at a temperature of 130° C. to form an intermediate layer having a film thickness of 2 μm on the conductive support (drum-shaped support).

(Formation of Charge Generating Layer)

A titanyl phthalocyanine (1.5 parts by mass) exhibiting one peak at a Bragg angle 2θ±0.2° of 27.2° in a Cu-Kα characteristic X ray diffraction spectrum and a polyvinyl acetal resin (S-LEC BX-5 manufactured by Sekisui Chemical Co., Ltd., 1 part by mass) were added to a solvent containing propylene glycol monomethyl ether (40 parts by mass) and tetrahydrofuran (40 parts by mass). Mixing was performed for two hours using a bead mill for dispersing the materials in the solvent to prepare an application liquid for charge generating layer formation. The prepared application liquid for charge generating layer formation was filtered using a filter having an opening of 3 μm. The resultant filtrate was applied by dip coating onto the intermediate layer formed as above and dried for five minutes at a temperature of 50° C. Through the above, a charge generating layer having a thickness of 0.3 μm was formed on the intermediate layer.

(Formation of Charge Transport Layer)

An X-form metal-free phthalocyanine (0.1 parts by mass) as a pigment, the charge transport material (CTM-1) (42 parts by mass) as a hole transport material, a hindered phenol-based antioxidant (IRGANOX (registered Japanese trademark) 1010 manufactured by BASF Japan Ltd., 2 parts by mass) as an additive, the polyarylate resin (Resin-1) (viscosity average molecular weight 45,000, 100 parts by mass) as a binder resin, and silica particles subjected to a surface treatment with hexamethyldisilazane (Aerosil (registered Japanese trademark) VP RX40S manufactured by Nippon Co., Ltd., number-average primary particle diameter 80 nm, 5 parts by mass) were added to a solvent containing 350 parts by mass of tetrahydrofuran and 350 parts by mass of toluene. Mixing was performed for 12 hours using a circulation-type ultrasonic disperser for dispersing the materials in the solvent to prepare an application liquid for charge transport layer formation.

According to the same manner as for the application liquid for charge generating layer formation, an application liquid for charge transport layer formation was applied onto the charge generating layer. Drying at a temperature of 120° C. was performed for 40 minutes to form a charge transport layer having a film thickness of 30 on the charge generating layer. As a result, the photosensitive member (A-1) was produced. The photosensitive member (A-1) had a structure in which the intermediate layer, the charge generating layer, and the charge transport layer are stacked in stated order on the conductive substrate.

[Photosensitive Member (A-2)]

A photosensitive member (A-2) was produced according to the same method as for the photosensitive member (A-1) in all aspects other than that the charge transport material (CTM-2) was used as a hole transport material instead of the charge transport material (CTM-1).

[Photosensitive Member (A-3)]

A photosensitive member (A-3) was produced according to the same method as for the photosensitive member (A-1) in all aspects other than that the charge transport material (CTM-3) was used as a hole transport material instead of the charge transport material (CTM-1).

[Photosensitive Member (A-4)]

A photosensitive member (A-4) was produced according to the same method as for the photosensitive member (A-1) in all aspects other than that the charge transport material (CTM-4) was used as a hole transport material instead of the charge transport material (CTM-1).

[Photosensitive Member (A-5)]

A photosensitive member (A-5) was produced according to the same method as for the photosensitive member (A-1) in all aspects other than that the charge transport material (CTM-5) was used as a hole transport material instead of the charge transport material (CTM-1).

[Photosensitive Member (A-6)]

A photosensitive member (A-6) was produced according to the same method as for the photosensitive member (A-1) in all aspects other than that the charge transport material (CTM-6) was used as a hole transport material instead of the charge transport material (CTM-1).

[Photosensitive Member (A-7)]

A photosensitive member (A-7) was produced according to the same method as for the photosensitive member (A-1) in all aspects other than that the charge transport material (CTM-7) was used as a hole transport material instead of the charge transport material (CTM-1).

[Photosensitive Member (A-8)]

A photosensitive member (A-8) was produced according to the same method as for the photosensitive member (A-1) in all aspects other than that the charge transport material (CTM-8) was used as a hole transport material instead of the charge transport material (CTM-1).

[Photosensitive Member (A-9)]

A photosensitive member (A-9) was produced according to the same method as for the photosensitive member (A-1) in all aspects other than that the charge transport material (CTM-9) was used as a hole transport material instead of the charge transport material (CTM-1).

[Photosensitive Member (A-10)]

A photosensitive member (A-10) was produced according to the same method as for the photosensitive member (A-1) in all aspects other than that the charge transport material (CTM-10) was used as a hole transport material instead of the charge transport material (CTM-1).

[Photosensitive Member (A-11)]

A photosensitive member (A-11) was produced according to the same method as for the photosensitive member (A-1) in all aspects other than that the polyarylate resin (Resin-2) having a viscosity average molecular weight of 47,500 was used instead of the polyarylate resin (Resin-1).

[Photosensitive Member (A-12)]

A photosensitive member (A-12) was produced according to the same method as for the photosensitive member (A-1) in all aspects other than that the polyarylate resin (Resin-3) having a viscosity average molecular weight of 46,000 was used instead of the polyarylate resin (Resin-1).

[Photosensitive Member (A-13)]

A photosensitive member (A-13) was produced according to the same method as for the photosensitive member (A-1) in all aspects other than that the polyarylate resin (Resin-4) having a viscosity average molecular weight of 50,000 was used instead of the polyarylate resin (Resin-1).

[Photosensitive Member (A-14)]

A photosensitive member (A-14) was produced according to the same method as for the photosensitive member (A-1) in all aspects other than that the polyarylate resin (Resin-5) having a viscosity average molecular weight of 50,200 was used instead of the polyarylate resin (Resin-1).

[Photosensitive Member (A-15)]

A photosensitive member (A-15) was produced according to the same method as for the photosensitive member (A-1) in all aspects other than that the polyarylate resin (Resin-6) having a viscosity average molecular weight of 49,400 was used instead of the polyarylate resin (Resin-1).

[Photosensitive Member (A-16)]

A photosensitive member (A-16) was produced according to the same method as for the photosensitive member (A-1) in all aspects other than that the polyarylate resin (Resin-7) having a viscosity average molecular weight of 40,000 was used instead of the polyarylate resin (Resin-1). Note that the polyarylate resin (Resin-7) had the same repeating unit as the polyarylate resin (Resin-1).

[Photosensitive Member (A-17)]

A photosensitive member (A-17) was produced according to the same method as for the photosensitive member (A-1) in all aspects other than that the polyarylate resin (Resin-8) having a viscosity average molecular weight of 32,000 was used instead of the polyarylate resin (Resin-1). Note that the polyarylate resin (Resin-8) had the same repeating unit as the polyarylate resin (Resin-1).

[Photosensitive Member (A-18)]

A photosensitive member (A-18) was produced according to the same method as for the photosensitive member (A-1) in all aspects other than that silica particles (Aerosil (registered Japanese trademark) RX300 manufactured by Nippon Aerosil Co., Ltd.) were used instead of the silica particles (VP RX40S manufactured by Nippon Aerosil Co., Ltd.).

[Photosensitive Member (A-19)]

A photosensitive member (A-19) was produced according to the same method as for the photosensitive member (A-1) in all aspects other than that silica particles (Aerosil (registered Japanese trademark) RX200 manufactured by Nippon Aerosil Co., Ltd.) were used instead of the silica particles (VP RX40S manufactured by Nippon Aerosil Co., Ltd.).

[Photosensitive Member (A-20)]

A photosensitive member (A-20) was produced according to the same method as for the photosensitive member (A-1) in all aspects other than that silica particles (Aerosil (registered Japanese trademark) NAX50 manufactured by Nippon Aerosil Co., Ltd.) were used instead of the silica particles (VP RX40S manufactured by Nippon Aerosil Co., Ltd.).

[Photosensitive Member (A-21)]

Silica particles (Aerosil (registered Japanese trademark) R974 manufactured by Nippon Aerosil Co., Ltd.) were used instead of the silica particles (VP RX40S manufactured by Nippon Aerosil Co., Ltd.). Further, dimethyldichlorosilane was used as a surface preparation agent instead of hexamethyldisilazane. A photosensitive member (A-21) was produced according to the same method as for the photosensitive member (A-1) in all aspects other than that the silica particles and the surface preparation agent were changed as described above.

[Photosensitive Member (A-22)]

Silica particles (Aerosil (registered Japanese trademark) RY200 manufactured by Nippon Aerosil Co., Ltd.) were used instead of the silica particles (VP RX40S manufactured by Nippon Aerosil Co., Ltd.). Further, polydimethylsiloxane was used as a surface preparation agent instead of hexamethyldisilazane. A photosensitive member (A-22) was produced according to the same method as for the photosensitive member (A-1) in all aspects other than that the silica particles and the surface preparation agent were changed as described above.

[Photosensitive Member (A-23)]

A photosensitive member (A-23) was produced according to the same method as for the photosensitive member (A-1) in all aspects other than that the content of the silica particles relative to 100 parts by mass of the binder resin was changed from 5 parts by mass to 0.5 parts by mass.

[Photosensitive Member (A-24)]

A photosensitive member (A-24) was produced according to the same method as for the photosensitive member (A-1) in all aspects other than that the content of the silica particles relative to 100 parts by mass of the binder resin was changed from 5 parts by mass to 2 parts by mass.

[Photosensitive Member (A-25)]

A photosensitive member (A-25) was produced according to the same method as for the photosensitive member (A-1) in all aspects other than that the content of the silica particles relative to 100 parts by mass of the binder resin was changed from 5 parts by mass to 10 parts by mass.

[Photosensitive Member (A-26)]

A photosensitive member (A-26) was produced according to the same method as for the photosensitive member (A-1) in all aspects other than that the content of the silica particles relative to 100 parts by mass of the binder resin was changed from 5 parts by mass to 15 parts by mass.

[Photosensitive Member (B-1)]

A photosensitive member (B-1) was produced according to the same method as for the photosensitive member (A-1) in all aspects other than that a polyarylate resin having a viscosity average molecular weight of 50,000 that is represented by chemical formula (Resin-9) was used instead of the polyarylate resin (Resin-1) as a binder resin. Note that the polyarylate resin represented by chemical formula (Resin-9) is a binder resin. The numerical subscripts (50) appearing in chemical formula (Resin-9) represent the rate (% by mole) of the amount of substance of the respective repeating units of the polyarylate resin (Resin-9).

(Resin-9)

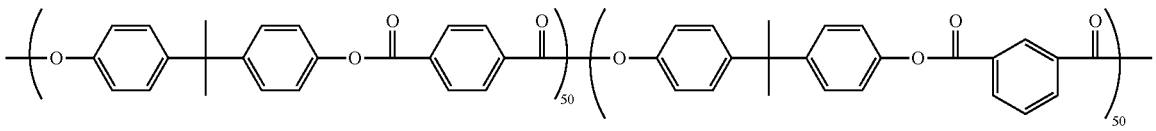

[Photosensitive Member (B-2)]

The content of the silica particles was changed from 5 parts by mass to 0 parts by mass (that is, the silica particles were not used). Furthermore, a polyarylate resin (Resin-10) having a viscosity average molecular weight of 52,500 was used instead of the polyarylate resin (Resin-1). A photosensitive member (B-2) was produced according to the same method as for the photosensitive member (A-1) in all aspects other than that the binder resin and the content of the silica particles were changed as described above. Note that the polyarylate resin (Resin-10) had the same repeating unit as the polyarylate resin (Resin-1).

[Photosensitive Member (B-3)]

A photosensitive member (B-3) was produced according to the same method as for the photosensitive member (A-1) in all aspects other than that a polycarbonate resin (Resin-11) having a viscosity average molecular weight of 49,500 was used instead of the polyarylate resin (Resin-1). Note that the polycarbonate resin (Resin-11) had a repeating unit represented by chemical formula (Resin-11) shown below.

(Resin-11)

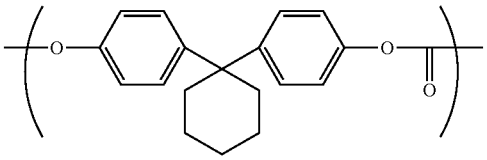

[Photosensitive Member (B-4)]

A photosensitive member (B-4) was produced according to the same method as for the photosensitive member (B-1) in all aspects other than that the content of the silica particles was changed from 5 parts by mass to 0.3 parts by mass.

[Photosensitive Member (B-5)]

A photosensitive member (B-5) was produced according to the same method as for the photosensitive member (B-1) in all aspects other than that the content of the silica particles was changed from 5 parts by mass to 20 parts by mass.

[Performance Evaluation of Photosensitive Member]

(Evaluation of Electrical Characteristics)

Each of the photosensitive members (A-1)-(A-27) and (B-1)-(B-5) was charged to −800 V while being rotated at a rotational speed of 31 rpm using a drum sensitivity test device produced by Gen-Tech, Inc. Subsequently, monochromatic light (wavelength 780 nm, exposure amount 1.0 $\mu J/cm^2$) was taken out from light of a halogen lamp using a bandpass filter and the surface of the photosensitive member was irradiated with the taken monochromatic light. After 50 milliseconds elapsed from the irradiation with the monochromatic light, the surface potential of the photosensitive member was measured. The measured surface potential was defined as a residual potential ($V_L$). The temperature and the humidity were set to 23° C. and 50% RH, respectively, as a measurement environment.

(Evaluation of Oil Crack Resistance of Photosensitive Member)

Finger oil was attached to one point of the surface of each of the photosensitive members (A-1)-(A-32) and (B-1)-(B-5) by press contact using a finger. Then, the photosensitive member was left for 48 hours (two days) under conditions of a temperature of 23° C. and a humidity of 50% RH. Thereafter, the surface of the photosensitive member to which the finger oil was attached was observed by eye and an optical microscope (produced by NIKON CORPORATION provided with a microscope digital camera DP20 (produced by Olympus Corporation, magnification 50×)) for counting the number of appearing cracks. Oil crack resistance of the photosensitive member was evaluated from the number of counted cracks in accordance with the following standard.

A: No crack was observed by eye and the microscope.

B: No crack was observed by eye but at least one crack was observed by the microscope.

C: Two to five cracks were observed by eye.

D: Six or more cracks were observed by eye.

(Evaluation of Abrasion Resistance of Photosensitive Member)

The application liquids for charge transport layer formation prepared for the corresponding photosensitive members (A-1)-(A-27) and (B-1)-(B-5) were each applied onto a polypropylene sheet having a thickness of 0.3 mm wound around an aluminum pipe having a diameter of 78 mm. The polypropylene sheet wound around the aluminum pipe was dried at a temperature of 120° C. for 40 minutes to prepare an abrasion evaluation test sheet on which a charge transport layer having a film thickness of 30 μm was formed.

The charge transport layer was peeled off from the polypropylene test sheet and attached to a specimen mounting card (S-36 produced by TABER Industries) to prepare a sample. An abrasion evaluation test was performed in a manner in which the prepared sample was set on a rotary ablation tester (produced by Toyo Seiki Seisaku-sho, Ltd.) and rotated 1,000 rounds under conditions of a load of 500 gf and a rotational speed of 60 rpm using a wear ring (CS-10 produced by TABER Industries). The abrasion loss (mg/1,000 rotations), which is a difference in mass of the sample before and after the abrasion evaluation test, was measured to evaluate the abrasion resistance of the photosensitive member based on the abrasion loss.

Tables 1-3 indicate materials contained in the charge transport layers of the respective photosensitive members (A-1)-(A-27) and (B-1)-(B-5). In Tables 1-3, the number-average primary particle diameter of the silica particles was measured according to the method for measuring an $N_2$ adsorption isotherm described in the above embodiment. Tables 4 and 5 indicate results of performance evaluation of the photosensitive members (A-1)-(A-27) and (B-1)-(B-5).

TABLE 1

| | Charge transport layer | | | | | | | |
|---|---|---|---|---|---|---|---|---|
| | Charge transport material | | Binder resin | | Silica particles | | | |
| Photosensitive member | Type | Content (part by mass) | Type | Viscosity average molecular weight | Type | Type of surface preparation agent | Number-average primary particle diameter (nm) | Content (part by mass) |
| A-1 | CTM-1 | 42 | Resin-1 | 45,000 | VP RX40S | Hexamethyldisilazane | 80 | 5 |
| A-2 | CTM-2 | 42 | Resin-1 | 45,000 | VP RX40S | Hexamethyldisilazane | 80 | 5 |
| A-3 | CTM-3 | 42 | Resin-1 | 45,000 | VP RX40S | Hexamethyldisilazane | 80 | 5 |
| A-4 | CTM-4 | 42 | Resin-1 | 45,000 | VP RX40S | Hexamethyldisilazane | 80 | 5 |
| A-5 | CTM-5 | 42 | Resin-1 | 45,000 | VP RX40S | Hexamethyldisilazane | 80 | 5 |
| A-6 | CTM-6 | 42 | Resin-1 | 45,000 | VP RX40S | Hexamethyldisilazane | 80 | 5 |
| A-7 | CTM-7 | 42 | Resin-1 | 45,000 | VP RX40S | Hexamethyldisilazane | 80 | 5 |
| A-8 | CTM-8 | 42 | Resin-1 | 45,000 | VP RX40S | Hexamethyldisilazane | 80 | 5 |
| A-9 | CTM-9 | 42 | Resin-1 | 45,000 | VP RX40S | Hexamethyldisilazane | 80 | 5 |
| A-10 | CTM-10 | 42 | Resin-1 | 45,000 | VP RX40S | Hexamethyldisilazane | 80 | 5 |
| A-11 | CTM-1 | 42 | Resin-2 | 47,500 | VP RX40S | Hexamethyldisilazane | 80 | 5 |
| A-12 | CTM-1 | 42 | Resin-3 | 46,000 | VP RX40S | Hexamethyldisilazane | 80 | 5 |
| A-13 | CTM-1 | 42 | Resin-4 | 50,000 | VP RX40S | Hexamethyldisilazane | 80 | 5 |
| A-14 | CTM-1 | 42 | Resin-5 | 50,200 | VP RX40S | Hexamethyldisilazane | 80 | 5 |
| A-15 | CTM-1 | 42 | Resin-6 | 49,400 | VP RX40S | Hexamethyldisilazane | 80 | 5 |

TABLE 2

| | Charge transport layer | | | | | | | |
|---|---|---|---|---|---|---|---|---|
| | Charge transport material | | Binder resin | | Charge transport material | | | |
| Photosensitive member | Type | Content (part by mass) | Type | Viscosity average molecular weight | Type | Type of surface preparation agent | Number-average primary particle diameter (nm) | Content (part by mass) |
| A-16 | CTM-1 | 42 | Resin-7 | 40,000 | VP RX40S | Hexamethyldisilazane | 80 | 5 |
| A-17 | CTM-1 | 42 | Resin-8 | 32,000 | VP RX40S | Hexamethyldisilazane | 80 | 5 |
| A-18 | CTM-1 | 42 | Resin-1 | 45,000 | RX300 | Hexamethyldisilazane | 7 | 5 |
| A-19 | CTM-1 | 42 | Resin-1 | 45,000 | RX200 | Hexamethyldisilazane | 12 | 5 |
| A-20 | CTM-1 | 42 | Resin-1 | 45,000 | NAX50 | Hexamethyldisilazane | 50 | 5 |
| A-21 | CTM-1 | 42 | Resin-1 | 45,000 | R974 | Dimethyldichlorosilane | 12 | 5 |
| A-22 | CTM-1 | 42 | Resin-1 | 45,000 | RY200 | Polydimethylsiloxane | 12 | 5 |
| A-23 | CTM-1 | 42 | Resin-1 | 45,000 | VP RX40S | Hexamethyldisilazane | 80 | 0.5 |
| A-24 | CTM-1 | 42 | Resin-1 | 45,000 | VP RX40S | Hexamethyldisilazane | 80 | 2 |
| A-25 | CTM-1 | 42 | Resin-1 | 45,000 | VP RX40S | Hexamethyldisilazane | 80 | 10 |
| A-26 | CTM-1 | 42 | Resin-1 | 45,000 | VP RX40S | Hexamethyldisilazane | 80 | 15 |

TABLE 3

| | Charge transport layer | | | | | | | |
|---|---|---|---|---|---|---|---|---|
| | Charge transport material | | Binder resin | | Charge transport material | | | |
| Photosensitive member | Type | Content (part by mass) | Type | Viscosity average molecular weight | Type | Type of surface preparation agent | Number-average primary particle diameter (nm) | Content (part by mass) |
| B-1 | CTM-1 | 42 | Resin-9 | 50,000 | VP RX40S | Hexamethyldisilazane | 80 | 5 |
| B-2 | CTM-1 | 42 | Resin-10 | 52,500 | | None | | |
| B-3 | CTM-1 | 42 | Resin-11 | 49,500 | VP RX40S | Hexamethyldisilazane | 80 | 5 |
| B-4 | CTM-1 | 42 | Resin-1 | 45,000 | VP RX40S | Hexamethyldisilazane | 80 | 0.3 |
| B-5 | CTM-1 | 42 | Resin-1 | 45,000 | VP RX40S | Hexamethyldisilazane | 80 | 20 |

TABLE 4

| Photosensitive member | Electric characteristic $V_L$ (V) | Oil crack resistance Evaluation | Abrasion resistance Abrasion loss (mg/1,000 rotations) |
|---|---|---|---|
| A-1 | −81 | A | 4.1 |
| A-2 | −78 | A | 3.2 |
| A-3 | −86 | A | 3.7 |
| A-4 | −93 | A | 3.7 |
| A-5 | −65 | B | 4.1 |
| A-6 | −88 | B | 4.2 |
| A-7 | −81 | B | 4.1 |
| A-8 | −111 | A | 3.3 |
| A-9 | −100 | B | 4.0 |
| A-10 | −77 | A | 3.4 |
| A-11 | −83 | A | 4.2 |
| A-12 | −82 | A | 3.7 |
| A-13 | −87 | A | 4.0 |
| A-14 | −87 | A | 4.0 |
| A-15 | −91 | A | 4.1 |
| A-16 | −85 | C | 4.5 |
| A-17 | −83 | C | 5.1 |
| A-18 | −84 | C | 4.2 |
| A-19 | −88 | B | 4.3 |
| A-20 | −84 | A | 4.0 |
| A-21 | −84 | C | 4.2 |

TABLE 5

| Photosensitive member | Electric characteristic $V_L$ (V) | Oil crack resistance Evaluation | Abrasion resistance Abrasion loss (mg/1,000 rotations) |
|---|---|---|---|
| A-22 | −86 | C | 4.2 |
| A-23 | −90 | A | 4.3 |
| A-24 | −82 | A | 4.0 |
| A-25 | −86 | B | 3.9 |
| A-26 | −85 | B | 3.4 |
| B-1 | −86 | B | 5.5 |
| B-2 | −92 | A | 6.1 |
| B-3 | −80 | B | 5.6 |
| B-4 | −91 | A | 5.5 |
| B-5 | −90 | D | 5.5 |

As indicated in Tables 1 and 2, the charge transport layers of the photosensitive members (A-1)-(A-26) each contained any of the charge transport materials (CTM-1)-(CTM-10). The charge transport layers thereof each contained any of the polyarylate resins (Resin-1)-(Resin-8) as a binder resin. Each of the polycarbonate resin (Resin-1)-(Resin-8) as a binder resin had a repeating unit represented by general formula (I). The charge transport layers thereof each contained the silica particles. The contents of the silica particles in the respective charge transport layers thereof each are at least 0.5 parts by mass and no greater than 15 parts by mass relative to 100 parts by mass of the binder resin.

As indicated in Table 3, the charge transport layer of the photosensitive member (B-1) contained the polyarylate resin (Resin-9) as a binder resin. The polyarylate resin (Resin-9) did not have the repeating unit represented by general formula (I). The charge transport layer of the photosensitive member (B-2) did not contain the silica particles. The charge transport layer of the photosensitive member (B-3) contained the polycarbonate resin (Resin-11) as a binder resin. The polycarbonate resin (Resin-11) was not a polyarylate resin having the repeating unit represented by general formula (I). The charge transport layer of the photosensitive member (B-4) contained the silica particles. The content of the silica particles was 0.3 parts by mass in the charge transport layer of the photosensitive member (B-4). The charge transport layer of the photosensitive member (B-5) contained the silica particles. The content of the silica particles was 20 parts by mass in the charge transport layer of the photosensitive member (B-5).

As indicated in Tables 4 and 5, the photosensitive members (A-1)-(A-26) each had an abrasion loss of at least 3.2 mg and no greater than 5.1 mg.

As indicated in Table 5, the photosensitive members (B-1)-(B-5) each had an abrasion loss of at least 5.5 mg and no greater than 6.1 mg.

As apparent from Tables 1-5, the abrasion loss of the photosensitive member according to the present disclosure (each of the photosensitive members (A-1)-(A-26)) was less than that of each of the photosensitive members (B-1)-(B-5) in the abrasion test. It is evident from the above that the photosensitive member according to the present disclosure is excellent in abrasion resistance.

As indicated in Table 2, the photosensitive member (A-19) contained the silica particles subjected to a surface treatment with hexamethyldisilazane. As indicated in Table 4, the photosensitive member (A-19) was evaluated as B in oil crack resistance evaluation.

As indicated in Table 2, the photosensitive members (A-21) and (A-22) contained the silica particles subjected to a surface treatment with dimethyldichlorosilane and polydimethylsiloxane, respectively. As indicated in Tables 4 and 5, the photosensitive members (A-21) and (A-22) were evaluated as C in oil crack resistance evaluation.

As apparent from Tables 2, 4, and 5, fewer cracks appeared in the photosensitive member (A-19) containing the silica particles subjected to a surface treatment with hexamethyldisilazane than in the photosensitive members (A-21) and (A-22) respectively containing the silica particles subjected to a surface treatment with dimethyldichlorosilane and polydimethylsiloxane in evaluation of oil crack resistance. As such, it is evident that surface treatment of the silica particles with hexamethyldisilazane can improve oil crack resistance of the photosensitive member according to the present disclosure.

As indicated in Tables 1 and 2, the silica particles contained in the respective photosensitive members (A-1), (A-19), and (A-20) had a number-average primary particle diameter of at least 12 nm and no greater than 80 nm. As indicated in Table 4, the photosensitive members (A-1), (A-19), and (A-20) were each evaluated as A or B in oil crack resistance evaluation.

As indicated in Table 2, the silica particles contained in the photosensitive member (A-18) had a number-average primary particle diameter of 7 nm. As indicated in Table 4, the photosensitive member (A-18) was evaluated as C in oil crack resistance evaluation.

As apparent from Tables 1, 2, and 4, fewer cracks appeared in the photosensitive members (A-1), (A-19), and (A-20), which each contained the silica particles having a number-average primary particle diameter of at least 10 nm, than in the photosensitive member (A-18), which contained the silica particles having a number-average primary particle diameter of less than 10 nm in evaluation of oils crack resistance. As such, it is evident that oil crack resistance can be improved in the photosensitive member according to the present disclosure when the silica particles have a number-average primary particle diameter of at least 10 nm and no greater than 80 nm.

As indicated in Table 1, the photosensitive members (A-1) and (A-11)-(A-15) each contained any of the polyarylate resins (Resin-1)-(Resin-6) as a binder resin. The polyarylate resins (Resin-1)-(Resin-6) each had a viscosity average molecular weight of at least 45,000 and no greater than 50,200. As indicated in Table 4, the photosensitive members (A-1) and (A-11)-(A-15) were each evaluated as A in oil crack resistance evaluation.

As indicated in Table 2, the photosensitive members (A-16) and (A-17) contained the polyarylate resin (Resin-7) and (Resin-8), respectively, as binder resins. The polyarylate resins (Resin-7) and (Resin-8) each had a viscosity average molecular weight of at least 32,000 and no greater than 40,000. As indicated in Table 4, the photosensitive members (A-16) and (A-17) were evaluated as C in oil crack resistance evaluation.

As apparent from Tables 1, 2, and 4, fewer cracks appeared in the photosensitive members (A-1) and (A-11)-(A-15), which each contained the polyarylate resin having a viscosity average molecular weight of greater than 40,000, than in the photosensitive members (A-16) and (A-17), which each contained the polyarylate resin having a viscosity average molecular weight of no greater than 40,000, in oil crack resistance evaluation. As such, oil crack resistance can be improved in the photosensitive member according to the present disclosure when the polyarylate resin has a viscosity average molecular weight of greater than 40,000.

What is claimed is:

1. A multi-layer electrophotographic photosensitive member comprising a conductive substrate and a photosensitive layer, wherein the photosensitive layer includes a charge generating layer containing a charge generating material and a charge transport layer containing a charge transport material, a binder resin, and silica particles, the charge transport layer is a monolayer disposed as an outermost surface layer of the multi-layer electrophotographic photosensitive member, the silica particles have a content of at least 0.5 parts by mass and no greater than 5 parts by mass relative to 100 parts by mass of the binder resin, the binder resin includes a polyarylate resin, the polyarylate resin is represented by chemical formula (Resin-3), (Resin-4), or (Resin-5) shown below, and the charge transport material contains a compound represented by chemical formula (CTM-1), (CTM-2), (CTM-3), (CTM-4), or (CTM-10) shown below:

(Resin-3)

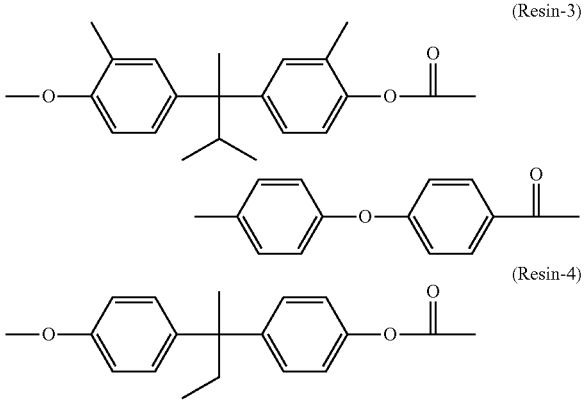

(Resin-4)

-continued

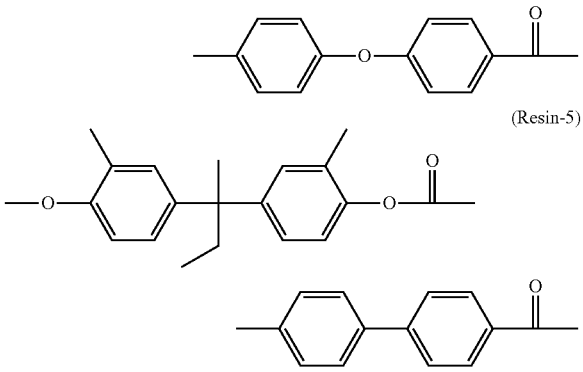

(Resin-5)

(CTM-1)

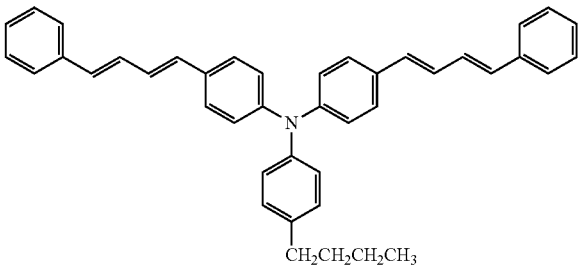

(CTM-2)

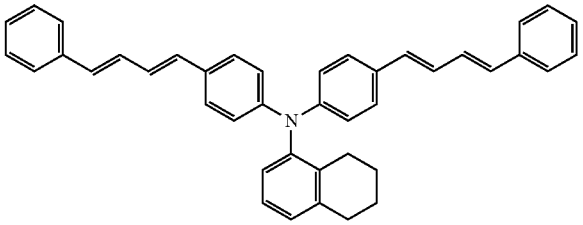

(CTM-3)

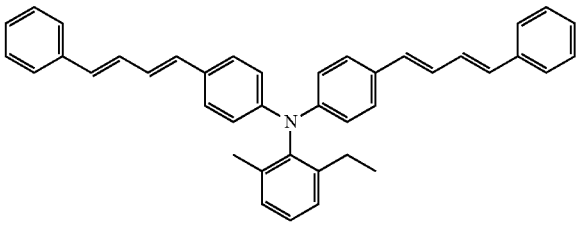

(CTM-4)

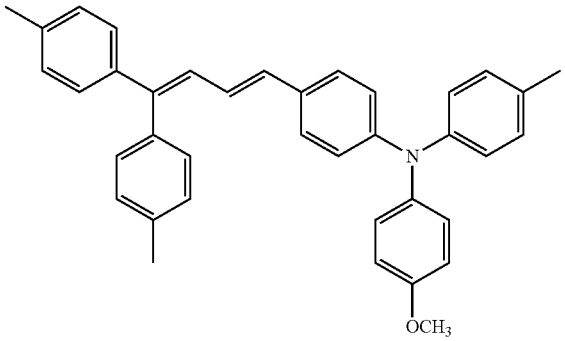

-continued

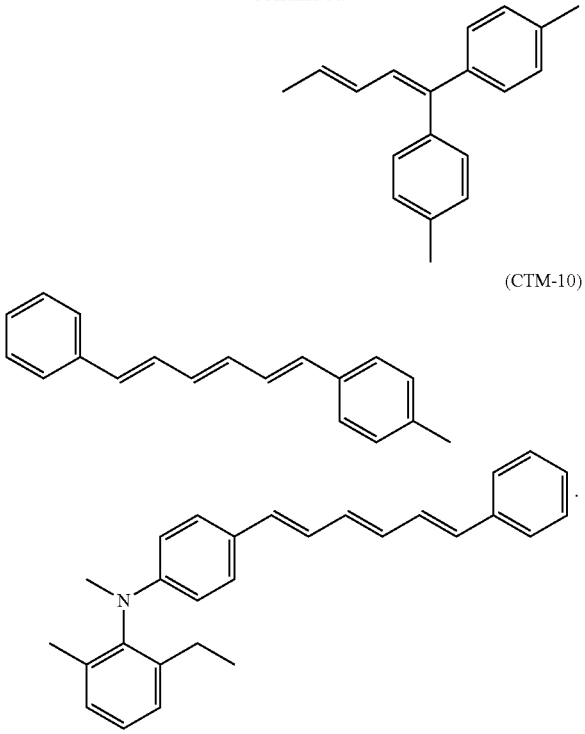

(CTM-10)

2. The multi-layer electrophotographic photosensitive member according to claim 1, wherein the silica particles each have a surface subjected to a surface treatment with hexamethyldisilazane.

3. The multi-layer electrophotographic photosensitive member according to claim 1, wherein the silica particles each have a surface having a portion represented by general formula (VI) shown below:

(VI)

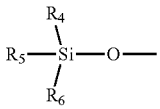

where in general formula (VI), $R_4$, $R_5$, and $R_6$ represent, independently of one another, an alkyl group or an aryl group.

4. The multi-layer electrophotographic photosensitive member according to claim 1, wherein the silica particles have a number-average primary particle diameter of at least 10 nm and no greater than 80 nm.

5. The multi-layer electrophotographic photosensitive member according to claim 1, wherein the binder resin has a viscosity average molecular weight of greater than 40,000.

* * * * *